US005754154A

United States Patent [19]

Katakura et al.

[11] Patent Number: 5,754,154

[45] Date of Patent: May 19, 1998

[54] LIQUID CRYSTAL DISPLAY APPARATUS

[75] Inventors: Kazunori Katakura, Atsugi; Shinjiro Okada, Isehara; Yutaka Inaba, Kawaguchi, all of Japan

[73] Assignee: Canon Kabushiki Kaisha, Tokyo, Japan

[21] Appl. No.: 435,956

[22] Filed: May 5, 1995

Related U.S. Application Data

[62] Division of Ser. No. 173,423, Dec. 23, 1993.

[30] Foreign Application Priority Data

| | | | |
|---|---|---|---|
| Dec. 25, 1992 | [JP] | Japan | 4-357908 |
| Apr. 9, 1993 | [JP] | Japan | 5-105986 |
| Apr. 15, 1993 | [JP] | Japan | 5-088661 |
| Dec. 24, 1993 | [JP] | Japan | 5-345886 |

[51] Int. Cl.[6] ..... G09G 3/36

[52] U.S. Cl. ..... 345/97; 345/101

[58] Field of Search ..... 345/101, 102, 345/98, 99, 100, 207, 94, 95, 96, 208, 209; 359/43, 44, 45, 85, 86, 87; 348/790, 792, 793; 349/72, 33, 34, 37

[56] References Cited

U.S. PATENT DOCUMENTS

| | | | |
|---|---|---|---|
| 3,921,162 | 11/1975 | Fukai et al. | 345/101 |
| 4,367,924 | 1/1983 | Clark et al. | 350/334 |
| 4,390,874 | 6/1983 | Woodside et al. | 345/101 |
| 4,563,059 | 1/1986 | Clark et al. | 350/330 |
| 4,621,261 | 11/1986 | Hehlen et al. | 345/101 |
| 4,639,089 | 1/1987 | Okada et al. | 350/341 |
| 4,655,561 | 4/1987 | Kanbe et al. | 350/350 S |
| 4,681,404 | 7/1987 | Okada et al. | 350/350 S |
| 4,709,995 | 12/1987 | Kuribayashi et al. | 350/350 S |
| 4,800,382 | 1/1989 | Okada et al. | 340/784 |
| 4,836,656 | 6/1989 | Mouri et al. | 350/350 S |
| 4,844,590 | 7/1989 | Okada et al. | 350/350 S |
| 4,865,425 | 9/1989 | Kobayashi et al. | 345/102 |
| 4,923,285 | 5/1990 | Ogino et al. | 345/97 |
| 4,932,659 | 6/1990 | Freeberg | 273/183 D |
| 4,938,574 | 7/1990 | Kaneko et al. | 350/350 S |
| 4,951,037 | 8/1990 | Goossen | 345/117 |
| 4,958,915 | 9/1990 | Okada et al. | 350/345 |
| 4,981,340 | 1/1991 | Kurematsu et al. | 350/333 |
| 5,058,994 | 10/1991 | Mihara et al. | 359/56 |
| 5,136,282 | 8/1992 | Inaba et al. | 340/784 |
| 5,321,419 | 6/1994 | Katakura et al. | 345/97 |

FOREIGN PATENT DOCUMENTS

| | | |
|---|---|---|
| 0002920 | 9/1979 | European Pat. Off. . |
| 0554066 | 8/1993 | European Pat. Off. . |
| 56-107216 | 8/1981 | Japan . |

OTHER PUBLICATIONS

"Voltage Dependent Optical Activity of a Twisted Nematic Liquid Crystal" M. Schadt and W. Helfrich in Applied Physics Letters, 1971, 18(4), 127–128.

Applied Physics Letters vol. 36, No. 11 (Jun. 1, 1980) pp. 899–901.

*Primary Examiner*—Xiao Wu

*Attorney, Agent, or Firm*—Fitzpatrick, Cella, Harper & Scinto

[57] ABSTRACT

A display panel includes a matrix of pixels each constituted by a pair of oppositely disposed electrodes and a liquid crystal disposed between the electrodes. A current signal, particularly one associated with inversion of spontaneous polarization of the liquid crystal is detected at plural pixels. The display panel is driven by applying drive signals thereto while correcting the drive signals based on the detected current signal. As a result, a threshold distribution typically attributable to a temperature distribution on the display panel is accurately compensated for. The display system thus constituted is particularly useful for gradational display.

5 Claims, 30 Drawing Sheets

**1: CONNECTED TO THE CURRENT DETECTION CIRCUIT

LIQUID CRYSTAL DISPLAY APPARATUS

This application is a division of application Ser. No. 08/173.423, filed Dec. 23. 1993.

FIELD OF THE INVENTION AND RELATED ART

The present invention relates to a liquid crystal display apparatus for computer terminals, television receivers, word processors, typewriters, etc., inclusive of a light valve for projectors, a view finder for video camera recorders, etc.

There have been known liquid crystal display devices including those using twisted-nematic (TN) liquid crystals, guest-host(G-H)-type liquid crystals, cholesteric (Ch) liquid crystals, smectic (Sm) liquid crystals, etc.

There have also been a well-known type of liquid crystal display devices wherein a liquid crystal compound is disposed between a group of scanning electrodes and a group of data electrodes constituting an electrode matrix so as to form a large number of pixels.

As a driving method for such a liquid crystal display device, there has been generally adopted a multiplexing drive scheme wherein an address signal is sequentially and selectively applied to the scanning electrodes and prescribed data signals are selectively applied to the data electrodes in parallel and in synchronism with the address signal.

The practical application of such a multiplexing drive scheme has been made by using a TN (twisted nematic) liquid crystal as disclosed in "Voltage Dependent Optical Activity of a Twisted Nematic Liquid Crystal" written by M. Schadt and W. Helfrich in Applied Physics Letters, 1971 18(4), p.p. 127–128.

In recent years, as an improvement for such a conventional liquid crystal device, Clark and Lagerwall have disclosed a bistable ferroelectric liquid crystal device using a surface-stabilized ferroelectric liquid crystal in, e.g., Applied Physics Letters, Vol. 36, No. 11 (Jun. 1, 1980), p.p. 899–901; Japanese Laid-Open Patent Application (JP-A) 56-107216, U.S. Pat. Nos. 4,367,924 and 4,563,059. Such a bistable ferroelectric liquid crystal device has been realized by disposing a liquid crystal between a pair of substrates disposed with a spacing small enough to suppress the formation of a helical structure inherent to liquid crystal molecules in chiral smectic C phase (SmC*) or H phase (SmH*) of bulk state and align vertical (smectic) molecular layers each comprising a plurality of liquid crystal molecules in one direction.

Further, as a display device using such a ferroelectric liquid crystal (FLC), one is known wherein a pair of transparent substrates respectively having thereon a transparent electrode and subjected to an aligning treatment are disposed to be opposite to each other with a cell gap of about 1–3 μm therebetween so that their transparent electrodes are disposed on the inner sides to form a blank cell, which is then filled with a ferroelectric liquid crystal, as disclosed in U.S. Pat. Nos. 4,639,089; 4,655,561; and 4,681,404. In such a device, the ferroelectric liquid crystal in its chiral smectic phase shows bistability, i.e., a property of assuming either one of a first and a second optically stable state depending on the polarity of an applied voltage and maintaining the resultant state in the absence of an electric field. Further, the ferroelectric liquid crystal shows a quick response to a change in applied electric field. Accordingly, the device is expected to be widely used in the field of e.g., a high-speed and memory-type display apparatus.

A liquid crystal display apparatus having a display panel constituted by such a ferroelectric liquid crystal device may be driven by a multiplexing drive scheme as described in U.S. Pat. Nos. 4,655,561, 4,709,995, 4,800,382, 4,836,656, 4,932,759, 4,938,574, and 5,058,994.

A ferroelectric liquid crystal (FLC) has been principally used in a binary (bright-dark) display device in which two stable states of the liquid crystal are used as a light-transmitting state and a light-interrupting state but can be used to effect a multi-value display, i.e., a halftone display. In a halftone display method, the areal ratio between bistable states (light transmitting state and light-interrupting state) within a pixel is controlled to realize an intermediate light-transmitting state. The gradational display method of this type (hereinafter referred to as an "areal modulation" method) will now be described in detail.

FIG. 1A-1 is a graph schematically representing a relationship between a transmitted light quantity I through a ferroelectric liquid crystal cell and a switching pulse voltage V. More specifically, FIG. 1A-1 shows plots of transmitted light quantities I given by a pixel versus voltages V when the pixel initially placed in a complete light-interrupting (dark) state is supplied with single pulses of various voltages V and one polarity as shown in FIG. 1A-2. When a pulse voltage V is below threshold Vth (V<Vth), the transmitted light quantity does not change and the pixel state is as shown in FIG. 1B-2 which is not different from the state shown in FIG. 1B-1 before the application of the pulse voltage. If the pulse voltage V exceeds the threshold Vth (Vth<V<Vsat), a portion of the pixel is switched to the other stable state, thus being transitioned to a pixel state as shown in FIG. 1B-3 showing an intermediate transmitted light quantity as a whole. If the pulse voltage V is further increased to exceed a saturation value Vsat (Vsat<V), the entire pixel is switched to a light-transmitting state as shown in FIG. 1B-4 so that the transmitted light quantity reaches a constant value (i.e., is saturated). That is, according to the areal modulation method, the pulse voltage V applied to a pixel is controlled within a range of Vth<V<Vsat to display a halftone corresponding to the pulse voltage.

However, in actually, the voltage (V)-transmitted light quantity (I) relationship shown in FIG. 1A-1 depends on the cell thickness and temperature. Accordingly, if a display panel is accompanied with an unintended cell thickness distribution or a temperature distribution, the display panel can display different gradation levels in response to a pulse voltage having a constant voltage. FIG. 2 is a graph for illustrating the above phenomenon which is a graph showing a relationship between pulse voltage (V) and transmitted light quantity (I) similar to that shown in FIG. 1A-1 but showing two curves including a curve H representing a relationship at a high temperature and a curve L at a low temperature. In a display panel having a large display size, it is rather common that the panel is accompanied with a temperature distribution. In such a case, however, even if a certain halftone level is intended to be displayed by application of a certain drive voltage Vap, the resultant halftone levels can be fluctuated within the range of $I_1$ to $I_2$ as shown in FIG. 2 within the same panel, thus failing to provide a uniform gradational display state. As shown in FIG. 2, FLC shows a higher switching voltage at a lower temperature and a lower switching voltage at a higher temperature, and the difference in switching voltage is generally much larger than that of a conventional TN-liquid crystal since the difference depends on a change in viscosity of the liquid crystal caused by a temperature change. Accordingly, the difference in gradation level due to a temperature distribution is much larger than that encountered in a TN-type liquid crystal, and this has been a main factor which makes difficult the realization of gradational display by FLC.

Further, in a conventional FLC device, a temperature change causes a remarkable change in drive margin, i.e., the range of voltage value or pulse width of a drive pulse allowing a practical display. As a result, there is no set of drive conditions, including application of a constant voltage and a constant pulse widths, capable of retaining a good display state over a temperature range of, e.g., 10° C. to 40° C.

In view of the above problems, it has been proposed to dispose a planar heater in the vicinity of a display section so as to keep the temperature at constant or to detect a temperature in the vicinity of a display panel so as to control the drive conditions, However, the resultant drive margin is still small so that the provision of a large-area panel remains difficult because it has been impossible to absorb threshold irregularities caused by cell thickness irregularity, waveform irregularity caused by delay in transmission of signal waveform, irregularity in liquid crystal alignment state, etc., besides temperature irregularity.

Further, in the case of gradational display using a conventional FLC device, the voltage value and pulse width of a drive pulse for displaying a desired gradation level vary remarkably so that, even if the above-mentioned method of providing a planar heater for keeping the temperature at a constant level, or the method of detecting a temperature in the vicinity of the display panel to control the drive conditions is adopted, it would still be impossible to absorb the threshold change due to a temperature irregularity over the display panel.

The above-mentioned problems are not restricted to the areal modulation method but are common to the binary display scheme of displaying two states of bright and dark.

SUMMARY OF THE INVENTION

A generic object of the present invention is to solve the above-mentioned problems.

A more specific object of the present invention is to provide a liquid crystal display apparatus capable of effecting a good display even if an nonuniformity in threshold occurs in a display area.

According to the present invention, there is provided a liquid crystal display apparatus, including:

a display panel comprising a matrix of pixels each comprising a pair of oppositely disposed electrodes and a liquid crystal disposed between the electrodes, detection means for detecting a current signal flowing across the liquid crystal at plural pixels on the display panel, drive means for applying drive signals to the display panel, and correction means for correcting the drive signals based on the current signal detected by the detection means.

These and other objects, features and advantages of the present invention will become more apparent upon a consideration of the following description of the preferred embodiments of the present invention taken in conjunction with the accompanying drawings, wherein like parts are denoted by like reference numerals.

BRIEF DESCRIPTION OF THE DRAWINGS

FIGS. 1B-1–1B-4 illustrate pixels showing various transmittance levels depending on applied pulse voltages.

FIG. 2 is a graph for describing a temperature dependence of voltage-transmitted light quantity characteristic.

FIG. 3 is a schematic view for illustrating a cell data detection means used in the invention.

DESCRIPTION OF THE PREFERRED EMBODIMENTS

First of all, a pixel current signal detection means used in the present invention will be described.

Figures 1, 1A:
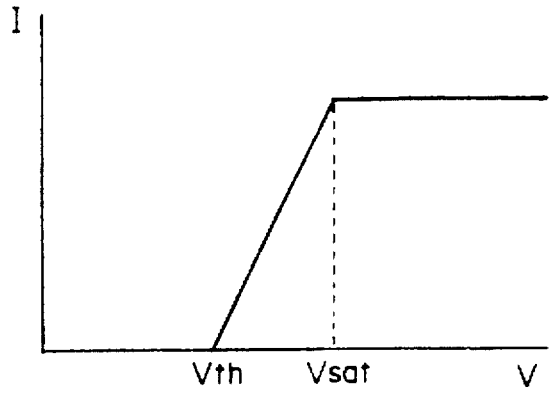
FIGS. 1A-1 and 1A-2 are graphs illustrating a relationship between switching pulse voltage and a transmitted light quantity contemplated in a conventional areal modulation method.
Figures 1, 1A, 2:
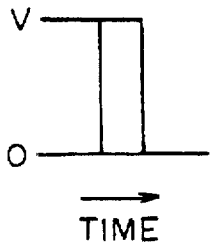
Figures 1, 1B, 2, 3, 4:
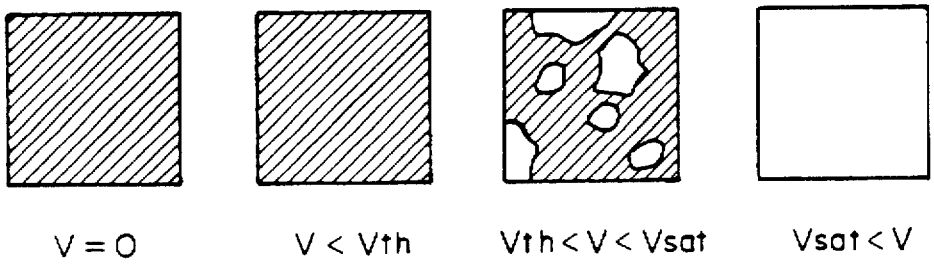
Figure 2:
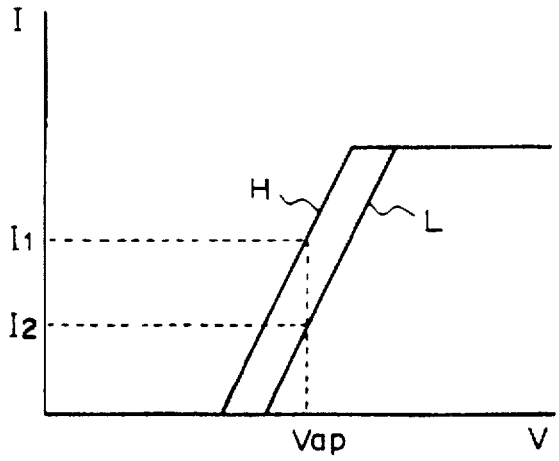
Figure 3:
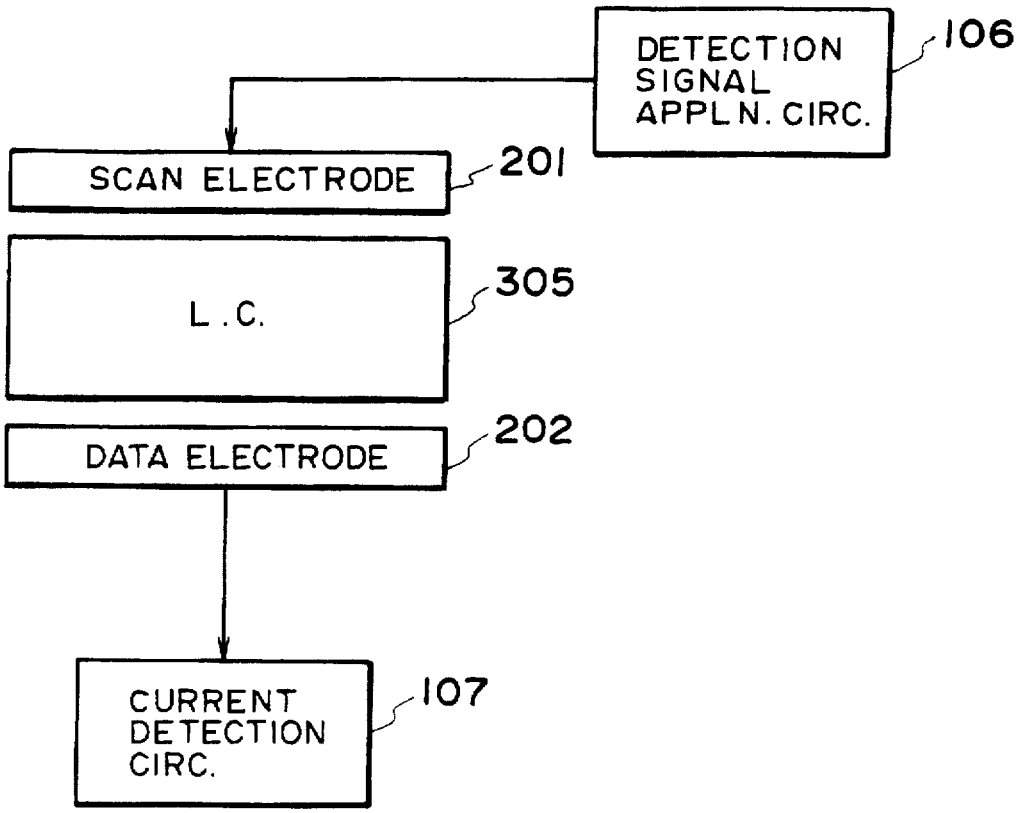

FIG. 3 is a schematic view for illustrating a current signal detection system. Referring to FIG. 3, the system includes a detection waveform application circuit 106 for applying a current signal detection input signals and a current detection circuit 107 for taking out a current signal detection output signal. The application circuit 106 is connected to a scanning electrode 201 and the detection circuit 107 is connected to a data electrode 202 which constitutes, together with the scanning electrode 201, a pair of electrodes sandwiching a liquid crystal 305 to form a pixel as a detection object.

Figure 4A:
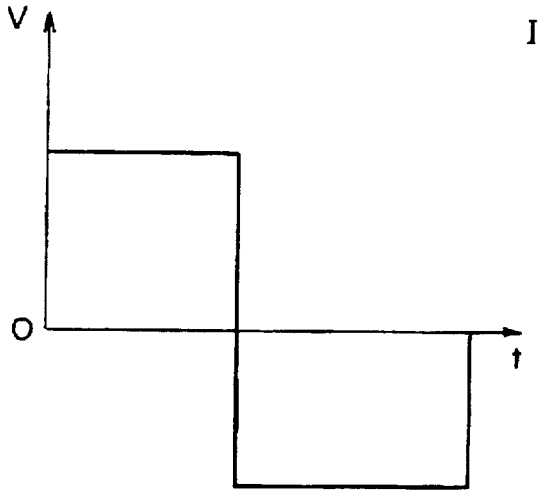
FIGS. 4A and 4B are diagrams showing an input signal waveform and an output signal waveform, respectively, for the cell detection means.
Figure 4B:
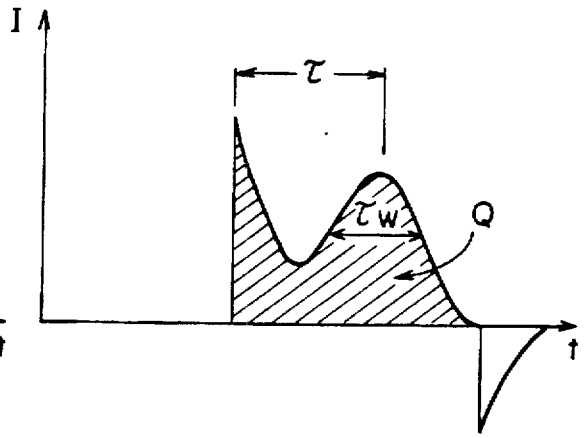

FIG. 4A shows a detection input signal and FIG. 4B shows a detection output signal.

Referring to FIG. 3, a voltage in a rectangular or ramp waveform is applied from the detection waveform application circuit 106 to the liquid crystal 305 through the scanning electrode 201 so as to detect a current flowing to the data electrode 202 including an internal current accompanying inversion of the spontaneous polarization of liquid crystal molecules. When a voltage waveform shown in FIG. 4A is applied, a current response as shown in FIG. 4B is obtained. When the temperature changes, the internal current due to the inversion of the spontaneous polarization changes its peak and total quantity. Similar changes occur corresponding to a change in applied voltage. Further, if the input waveform is delayed, the rising form of an external current accompanying the switching of an external electric field changes. Accordingly, if the parameters, such as a peak time $\tau$, a total charge Q, a peak half-value width $\tau_w$, etc., of a current response as shown in FIG. 4B are measured, the current threshold characteristic of a pixel concerned can be detected.

In the present invention, the display operation is corrected based on the detected threshold data.

Figure 5:
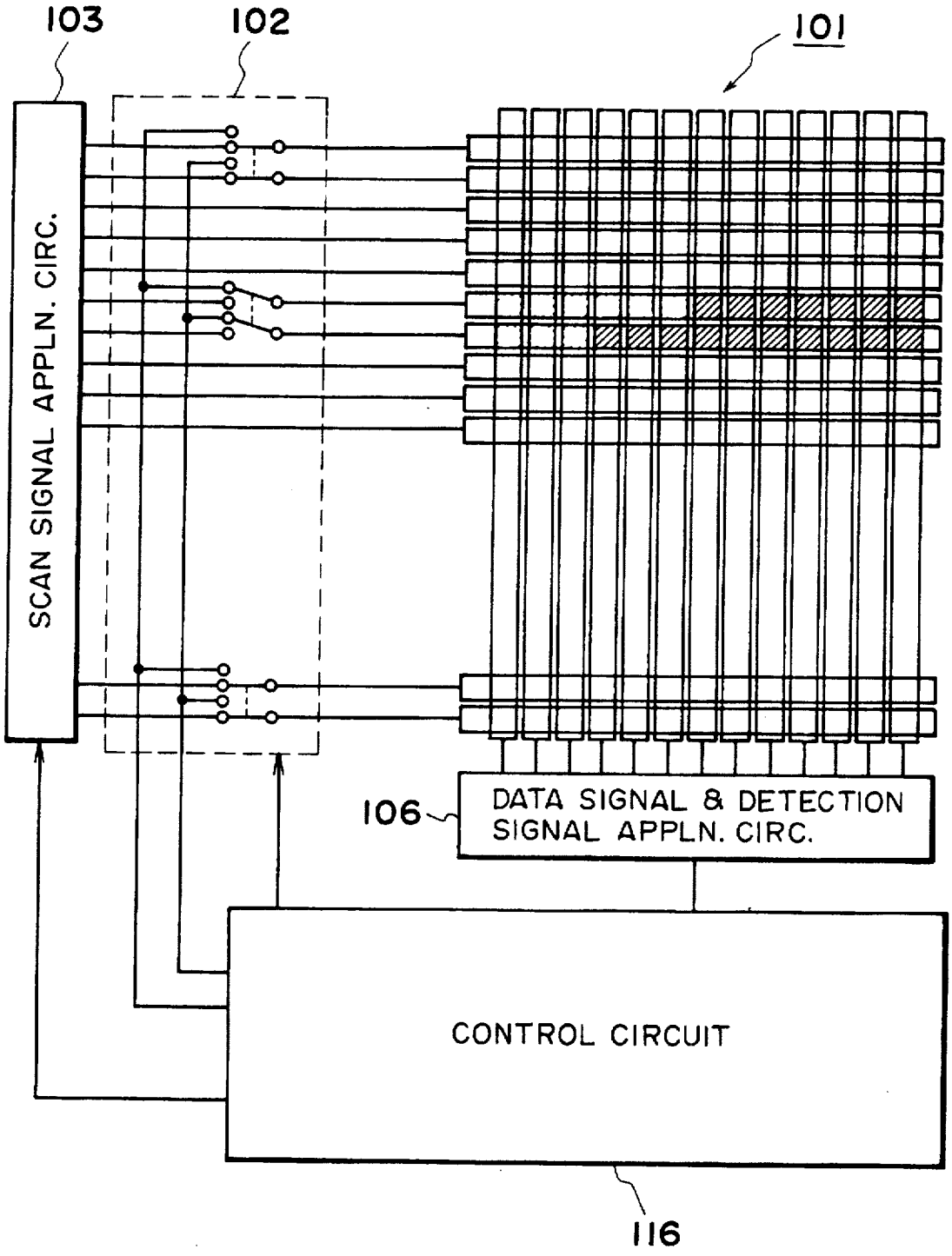
FIG. 5 is a block diagram of a liquid crystal display apparatus according to the present invention.

FIG. 5 is a block diagram of a liquid crystal display apparatus including such a detection system. Prescribed pixels (hatched pixels) among a large number of pixels constituted by an electrode matrix in a liquid crystal display device 101 are supplied with a detection input signal from a detection signal application circuit 106 (also functioning as a data signal application circuit). Output signals from the prescribed pixels are outputted through electrodes concerned (scanning electrodes in this case) and a changeover circuit 102 to a control circuit 116.

The changeover circuit 102 may be constituted as shown in FIG. 5 so that it includes changeover switches on only electrodes leading to previously determined pixels to be detected or may be constituted so that all electrodes are provided with a changeover switch so as to allow selection of an arbitrary pixel.

In a case where a correction is required, corrected display drive signals are supplied from a scanning electrode driver 103 and the data electrode driver 106 (also functioning as a detection signal application circuit as described above) based on a correction instruction issued from the control circuit. At this time, the changeover switches in the circuit 102 are switched to connect the electrodes concerned to the scanning electrode driver 103.

The detection signal may be applied to data electrodes as in the above embodiment or alternately to scanning electrodes, as desired, so as to fit an entire system.

Figure 6:
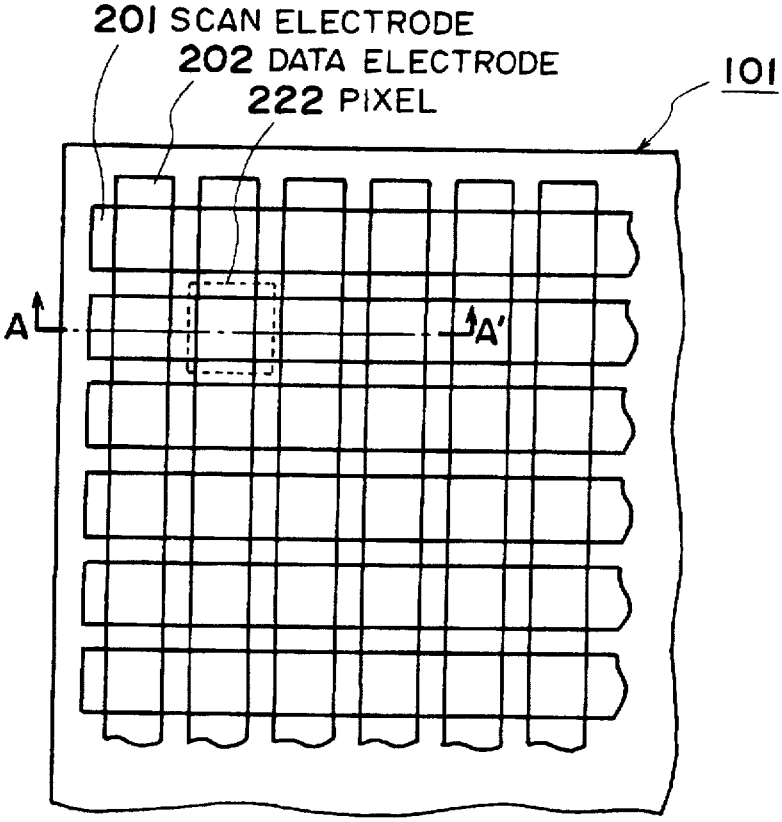
FIG. 6 is a schematic view of a display section having an electrode matrix used in the invention.
Figure 7:
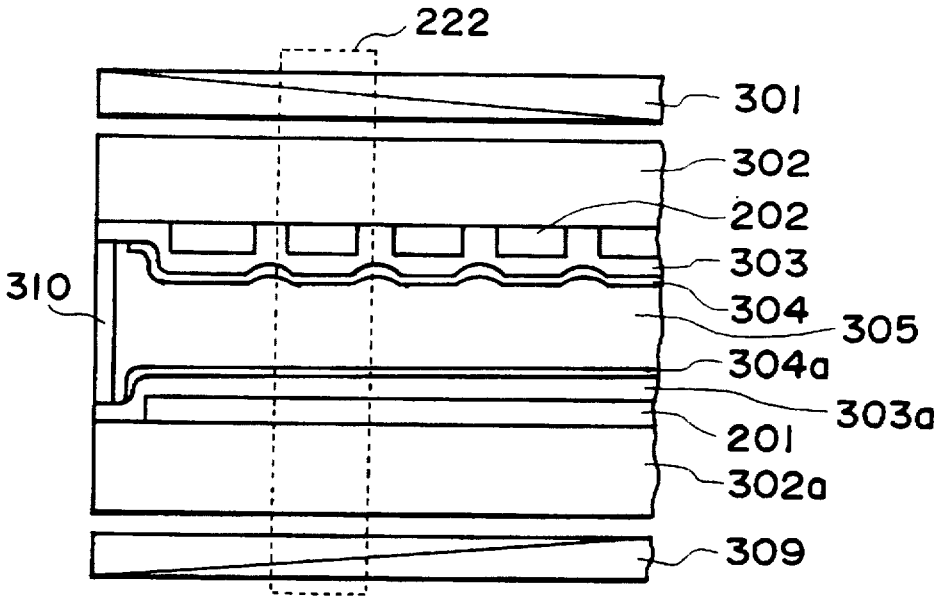
FIG. 7 is a sectional view of the display section shown in FIG. 6.

FIG. 6 is a partial top plan view of a liquid crystal display panel 101 (display section), and FIG. 7 is a partial sectional view taken along line A—A' as viewed in the direction of arrows.

Referring to FIG. 6, the panel 101 includes scanning electrodes 201 and data electrodes 202 intersecting the scanning electrodes 201. The scanning electrodes and data electrodes form an electrode matrix (pixel matrix) constituting a pixel 222 as a display unit at each intersection of the scanning electrodes and the data electrodes. Referring to FIG. 7, the panel further includes glass substrates 302 and **302*a* carrying the data electrodes 202 and the scanning electrodes 201, respectively, insulating films 303 and 303*a*, alignment films 304 and 304*a*, a liquid crystal 305, and a sealing member 310, which form a cell (panel) structure in combination, and further an analyzer 301 and a polarizer 309 disposed in cross nicols sandwiching the cell structure. The liquid crystal 305** usable in the present invention may include a nematic liquid crystal, a cholesteric liquid crystal and a smectic liquid crystal. It is particularly suitable to use a smectic liquid crystal showing ferroelectricity.

A representative example of such a liquid crystal may be a ferroelectric liquid crystal mixture containing a pyrimidine component and showing a phase transition series as shown in the following Table 1 and spontaneous polarization Ps and an optical response time $\tau$ (causing a transmittance change of 0→90%) under application of rectangular pulses of ±4 volts and 5 Hz as shown in Table 2 below.

TABLE 1

| | | | | | | | | | |
|---|---|---|---|---|---|---|---|---|---|
| Iso | 85.4° C. / 84.9° C. | Ch | 71.2° C. / 72.6° C. | SmA | 58.5° C. / 59.4° C. | SmC | −23.5° C. / −18.1° C. | Cryst |

TABLE 2

| | 10° C. | 20° C. | 30° C. | 40° C. | 50° C. |
|---|---|---|---|---|---|
| Ps (nC/cm$^2$) | 7.0 | 6.2 | 5.0 | 3.9 | 2.6 |
| $\tau$ (μsec) | 230 | 170 | 125 | 95 | 85 |

The present invention aims at providing a good display on a large-area panel regardless of temperature and further provides a stable gradational display. For this purpose, it is necessary to accurately compensate for threshold irregularity over the display panel. Accordingly, the apparatus of the present invention includes means for defining a current flowing through the liquid crystal layer including a polarization inversion current and correcting data signals and scanning signals for display. In order to more accurately detect the current without impairing the image quality thereby, it is desirable to satisfy at least one of the following features (1)–(7).

(1) Measurement at plural points.

At plural points on a pixel matrix, the current is detected to evaluate a threshold distribution over the display panel, particularly over the display area constituted by a pixel matrix (electrode matrix) and, based on the threshold distribution, corresponding correction of display signals is effected. Herein, the term "pixel" is intended to also mean a cell unit having a structure identical to a pixel, i.e., a pair of electrodes and a liquid crystal disposed therebetween, but actually not contributing to the display as by masking or disposition at a marginal part of the display panel, in addition to a pixel in an ordinary sense, i.e., a display element.

The increase in number of detected pixels tends to result in difficulties such that a longer time is required for the measurement and a complicated current detection circuit is required, thus leading to necessity of an IC of a large capacity and an increase in production cost. On the other hand, mutually adjacent pixels are at a substantially equal temperature, so that the measurement at all the pixels is unnecessary.

In the case of a display panel having about 1000×1000 pixels, measurement at about 100×100 pixels may be sufficient. In this instance, such measured pixels (hereinafter referred to as "detection pixel(s)" may preferably be distributed not uniformly but in different densities such that detection pixels are disposed at a higher density at a part having more severe temperature irregularity such as a part close to electrode drivers, or a part having a more severe alignment irregularity, such as a part close to the liquid crystal injection port of the panel. In a preferred embodiment, in connection with the IC structure designed to output 128 bits as a unit, one detection pixel is selected per 16×16 pixels and locally per 8×8 pixels. A better result may be obtained if correction data for non-detection pixels are obtained by interpolation based on correction data at the detection pixels.

(2) Applying the current detection signal to scanning electrodes.

If the current detection is performed, pixels in a region or along a detection current input electrode cannot retain the display state but are brought into a first or second stable state or a mixture of such two stable states. In order to maintain a good image quality, the pixels having disordered images should be rewritten quickly. In the case of applying a detection waveform to a scanning electrode and detecting through a data electrode, only the scanning electrode supplied with the detection waveform is required to be scanned for image display. For example, in the case of using three scanning electrodes for current detection at a time, the image disorder caused thereby over the entire display area can be removed by scanning and writing only on the three scanning electrodes. This is faster by 300–400 times than one frame period which is required to remove an image disorder caused in the case where a current detection signal is applied to a data electrode, thus causing an image disorder along the data electrode. As a result, the required time for removing image disorder is limited to a very short time which does not leave a noticeable image disorder. As will be described hereinafter, a larger S/N ratio is attained if the current detection is performed at a larger number of pixels at one time but it is important that the rewriting for removing image disorder as a post treatment of the current detection is completed within a period unnoticeable to the human eye.

(3) Detecting the current from plural pixels at one time.

If a current from a pixel at a central part of the display panel is detected at an end of the data electrode concerned, the current may be very small, so small that it can be hidden by a noise. The S/N ratio is liable to be decreased in a larger-size display panel. In order to increase the signal, it is desired that the currents from plural pixels are collectively detected. In a case where, the output currents from plural pixels along a data electrode are detected collectively, the rewriting after the detection may require increased time as described above so that the number of detection pixels at one time should be limited so as to complete the rewriting within an unnoticeable time. Further, in the case of detecting the currents from pixels along a data electrode, it is necessary to change over between the state wherein plural data electrodes are connected to a current detection element for detection and the state wherein such plural data electrodes are connected to respective data signal application elements separately, so that the number of the detection pixels along a data electrode should be limited within an extent of not making the IC complicated or excessively enlarged thereby. In any case, the detection pixels should be disposed collectively in a narrow region so that the respective pixels are at a substantially identical temperature.

(4) Controlling the current detection condition based on temperature data.

The peak and integrated value of the current vary remarkably depending on temperatures, e.g., by 2–4 times between 10° C. and 40° C. Accordingly, if a single detection condition is fixedly used for the entire temperature region, a higher temperature region causing a quicker response of the liquid crystal requires a shorter period for detection than at a lower temperature region but is liable to result in a relatively coarse measurement accuracy. Accordingly, it is sometimes appropriate to change the resetting pulse, detection pulse, detection period, sampling (detection) frequency, detection timing, location, number and area of detection pixels, etc., depending on whether it is located in a high-temperature region or in a low-temperature region, so as to retain a certain level of measurement accuracy regardless of the temperature.

(5) Common use of a pixel.

A pixel used for display is also used as a current detection element (detection pixel) for direct measurement the current therefrom. This may be advantageous for removing measurement error due to an indirect measurement. In this instance, the pixel concerned is subjected to the displaying operation and the current detection operation alternately by time-sharing.

(6) Comparison of both the peak and integrated value.

The influence of temperature can be understood by the peak time alone or by the integrated value alone of a detected current response; but, if the peak time and integrated value are measured in combination, it is possible to estimate the temperature, cell thickness and delay of a waveform applied to the electrode simultaneously. It is also possible to apply different waveforms depending on causes of threshold irregularities in such a manner that an amplitude-modulated signal is applied to a pixel at a high temperature and a pulse width-modulated signal is applied to a pixel accompanied with a severe delay in waveform.

(7) Correction based on a current differential.

The response current includes a charging current, an ionic current, etc., in addition to a Ps inversion current. The threshold characteristic of a detection pixel well corresponds to the Ps inversion current. Accordingly, by taking a differential current so as to minimize the contribution by factors other than the Ps inversion current, it is possible to obtain a higher sensitivity to the Ps inversion current. For this purpose, a current response in the case of no pixel state inversion in response to a detection input signal is detected and compared with a current response in the case of pixel state inversion to obtain a differential, based on which display drive signals are corrected.

The following Examples are presented for describing embodiments wherein one or more of the above features are adopted alone or in combination. The present invention is however not restricted to such embodiments but should be understood to cover modifications by substituting alternative or equivalent features for some features characterized in the embodiments.

(EXAMPLE 1)

Figure 8:
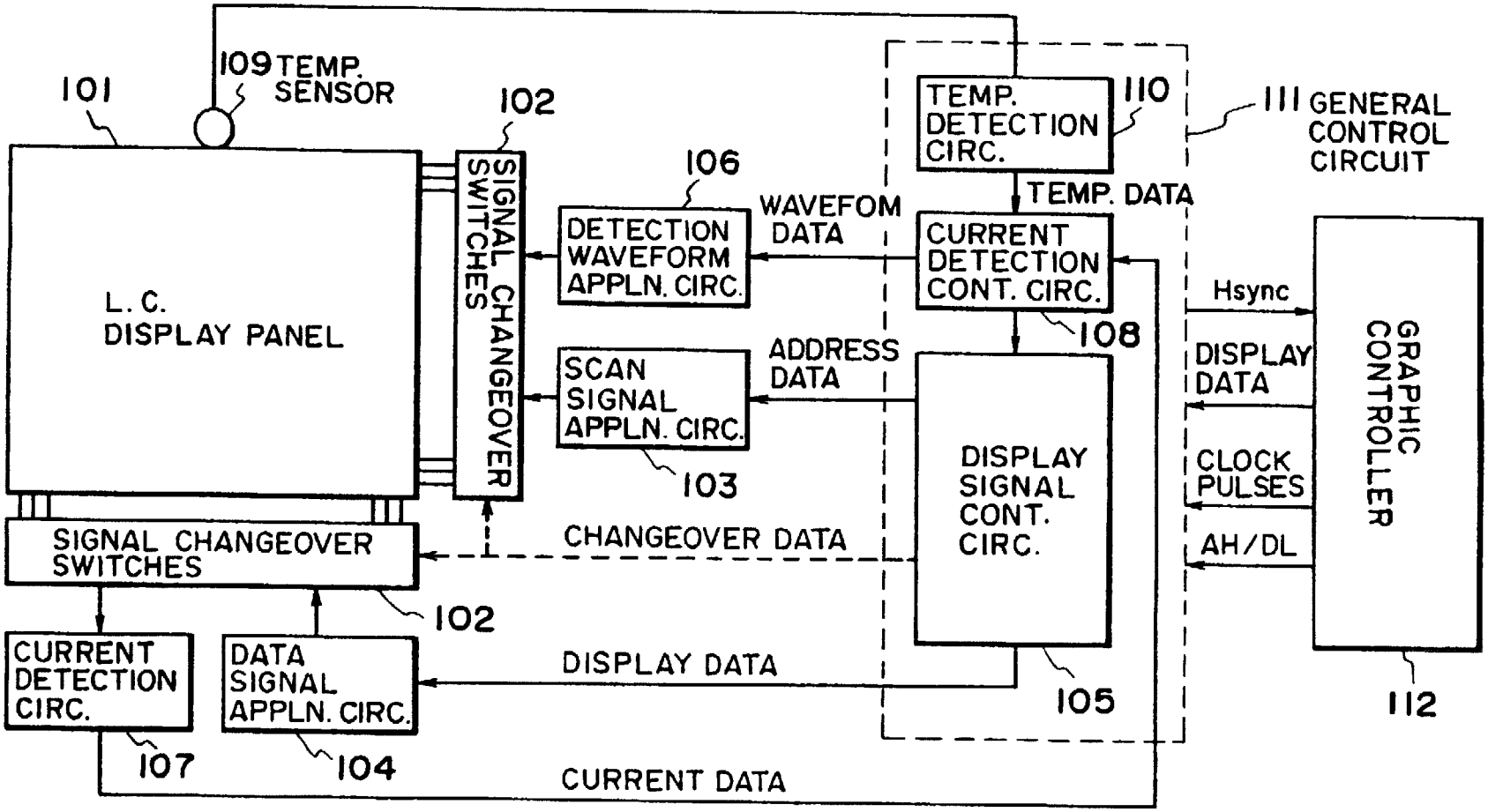
FIG. 8 is a block diagram of an embodiment of the liquid crystal display apparatus according to the invention.

FIG. 8 is a block diagram of a liquid crystal display apparatus according to an embodiment of the present invention. The display apparatus includes a liquid crystal display panel 101, signal changeover switches 102, a scanning signal application circuit 103, a data signal application circuit 104, a display signal control circuit 105, a detection waveform Application circuit 107, 106, a current detection circuit 107, a current detection control circuit 108, a temperature detection element (temperature sensor) 109, a temperature detection circuit 110, a general control circuit 111, and a graphic controller 112.

A temperature in the vicinity of the display panel 101 is detected by the temperature sensor 109, and the resultant temperature data is inputted through the temperature detection circuit 110 to the display signal control circuit 105 and the current detection control circuit 108. The current detection control circuit 108 instructs the detection waveform application circuit 106 to apply an appropriate current detection waveform based on the temperature data. The waveform applied via the signal changeover switches 102 to the display panel 101 and a response signal from the panel 101 is received by the current detection circuit 107 to be converted into current data, which is inputted to the current detection control circuit 108.

The display signal control circuit 105 receives display data from the graphic controller 112, converts and corrects the display data based on the above obtained temperature data and current data and supplies address data and display data based thereon to the scanning signal application circuit 103 and the data signal application circuit 104, respectively. The scanning signal application circuit 103 and the data signal application circuit 104 apply scanning signals and data signals, respectively, to the liquid crystal display panel 101 to effect image display thereon.

Whether the image display or current detection is determined by the general control circuit 111 with reference to the temperature data and the current data and controlled by the signal changeover switches 102.

Figure 9A:
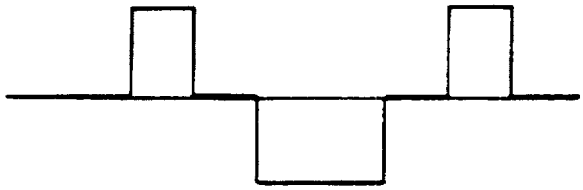
FIGS. 9A–9F show a set of display drive signal waveforms.
Figure 9B:
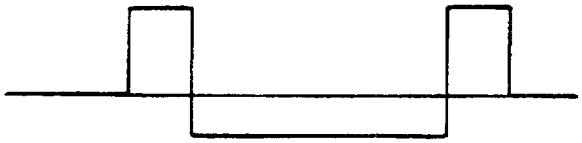
Figure 9C:
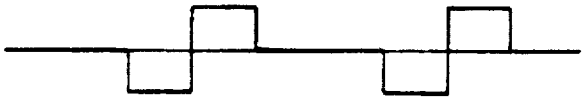
Figure 9D:
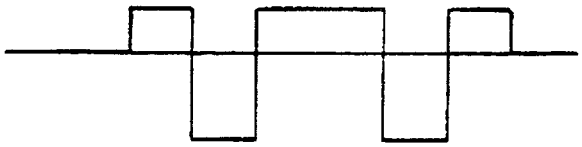
Figure 9E:
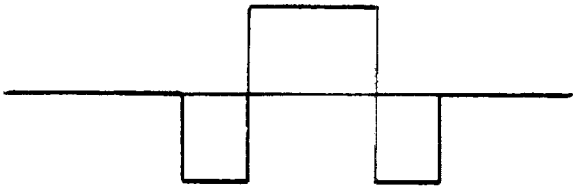
Figure 9F:
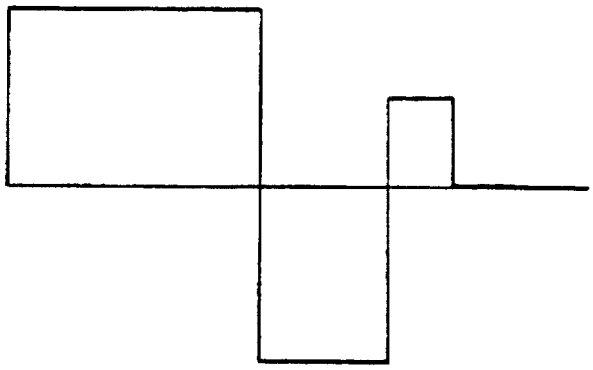

A set of display signal waveforms used in this embodiment are shown in FIGS. 9A–9F. At FIGS. 9A–9E are shown data signals applied to the data electrodes, and at FIG. 9F is shown a scanning selection signal applied to the scanning electrodes. By appropriate selection of waveforms of FIGS. 9A–9E, good display may be effected regardless of a threshold irregularity distributed on a scanning electrode. For example, in the case of gradational display, the waveform of FIG. 9A is used to display a 0% transmission state, the waveform of FIG. 9B is used to display a 50%-transmission state and the waveform of FIG. 9C is used to display a 100%-transmission state in a high temperature region on a scanning electrode. On the other hand, in a low temperature region on the scanning electrode, the waveform of FIG. 9C is used for a 0% state, the waveform of FIG. 9D is used for a 50% state, and the waveform of FIG. 9E is used for a 100% state.

The amplitude and pulse width of each waveform may preferably be controlled based on a threshold distribution on a scanning electrode, as a matter of principle. However, in a case where the threshold distribution on the panel and the threshold distribution on the scanning electrode are not substantially different, the waveforms can be controlled solely based on the temperature data while disregarding the current data in order to simplify the control circuit.

Figure 10A:
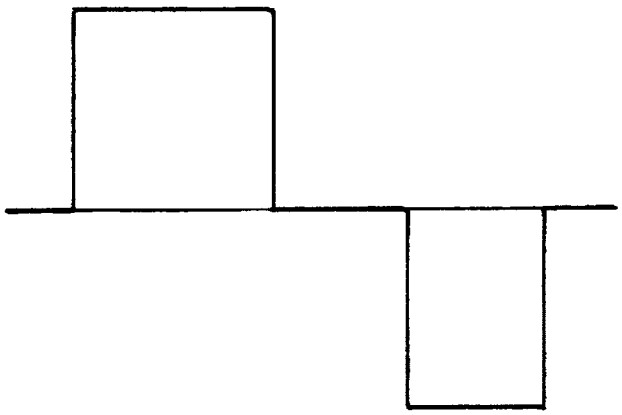
FIGS. 10A and 10B respectively show another embodiment of current detection waveform used in the invention.
Figure 10B:
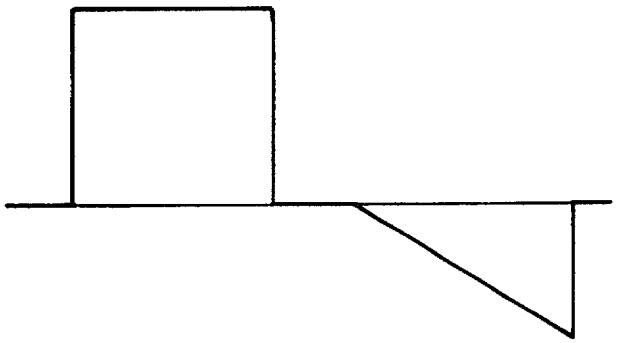

FIGS. 10A and 10B respectively show another example of waveform applied to a scanning electrode for current detection. In each waveform, a first pulse is applied so as to completely reset a detection pixel into a first stable or a second stable state, and a second pulse is applied so as to detect a current from the detection pixel after the application thereof. The amplitude and pulse width of each of the first and second pulses are both controlled by the temperature data. The pixel after application of the second pulse and before writing thereafter does not display image data. In this instance, in the case where neighboring pixels preferentially display the first stable state, the second pulse for current detection may preferably be set to a polarity providing the second stable state so as to make the non-displaying pixels less noticeable.

(EXAMPLE 2)

Figure 11:
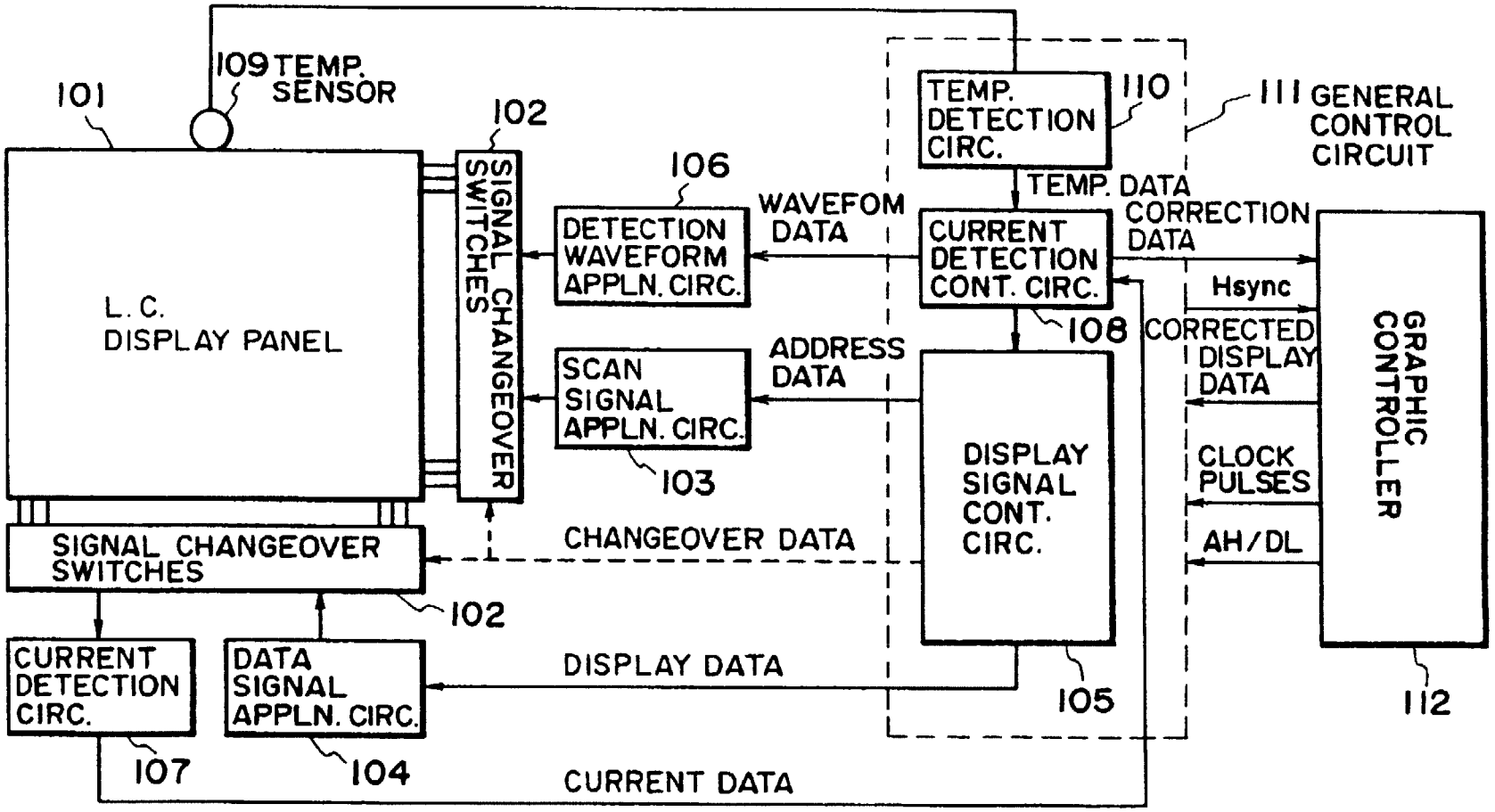
FIG. 11 is a block diagram showing another embodiment of the liquid crystal display apparatus according to the invention.

FIG. 11 is a block diagram of a liquid crystal display apparatus according to another embodiment of the present invention, having a control system somewhat different from the one in the embodiment of FIG. 8.

Different from the embodiment of FIG. 8, the control circuit 111 in this embodiment of FIG. 11 supplies correction data calculated from the temperature data and current data to the graphic controller 112, from which already corrected display data are supplied to the display signal control circuit 105.

Figure 12A:
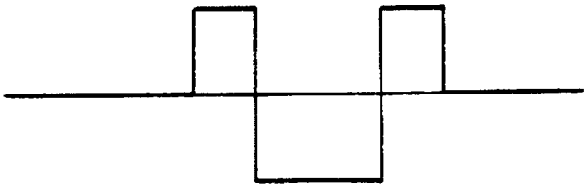
FIGS. 12A–12F show another set of display drive signals used in the invention.
Figure 12B:
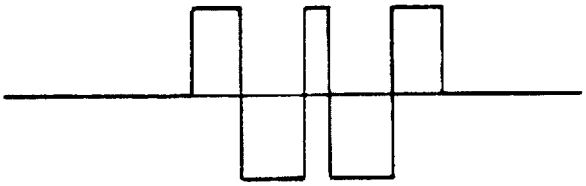
Figure 12C:
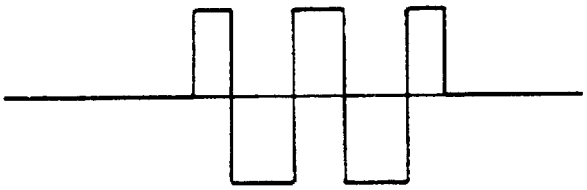
Figure 12D:
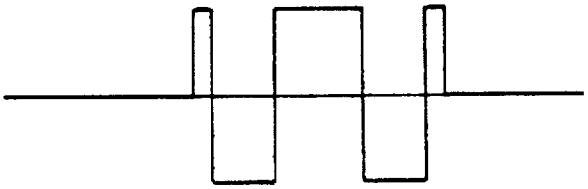
Figure 12E:
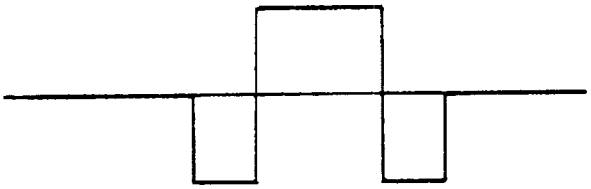
Figure 12F:
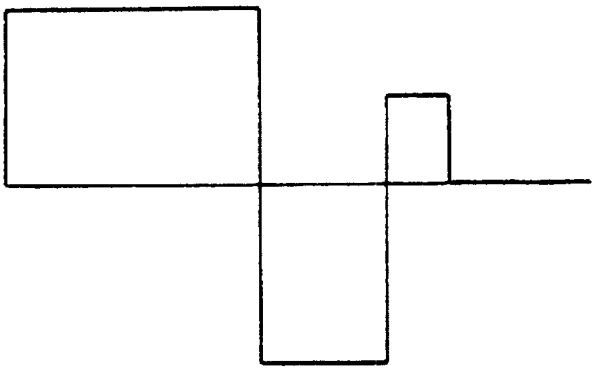

FIGS. 12A–12F show another example set of display signal waveforms different from that shown in FIGS. 9A–9F. Also in FIGS. 12A–12F, at FIGS. 12A–12E are shown data signals and at FIG. 12F is shown a scanning selection signal.

(EXAMPLE 3)

Figure 13:
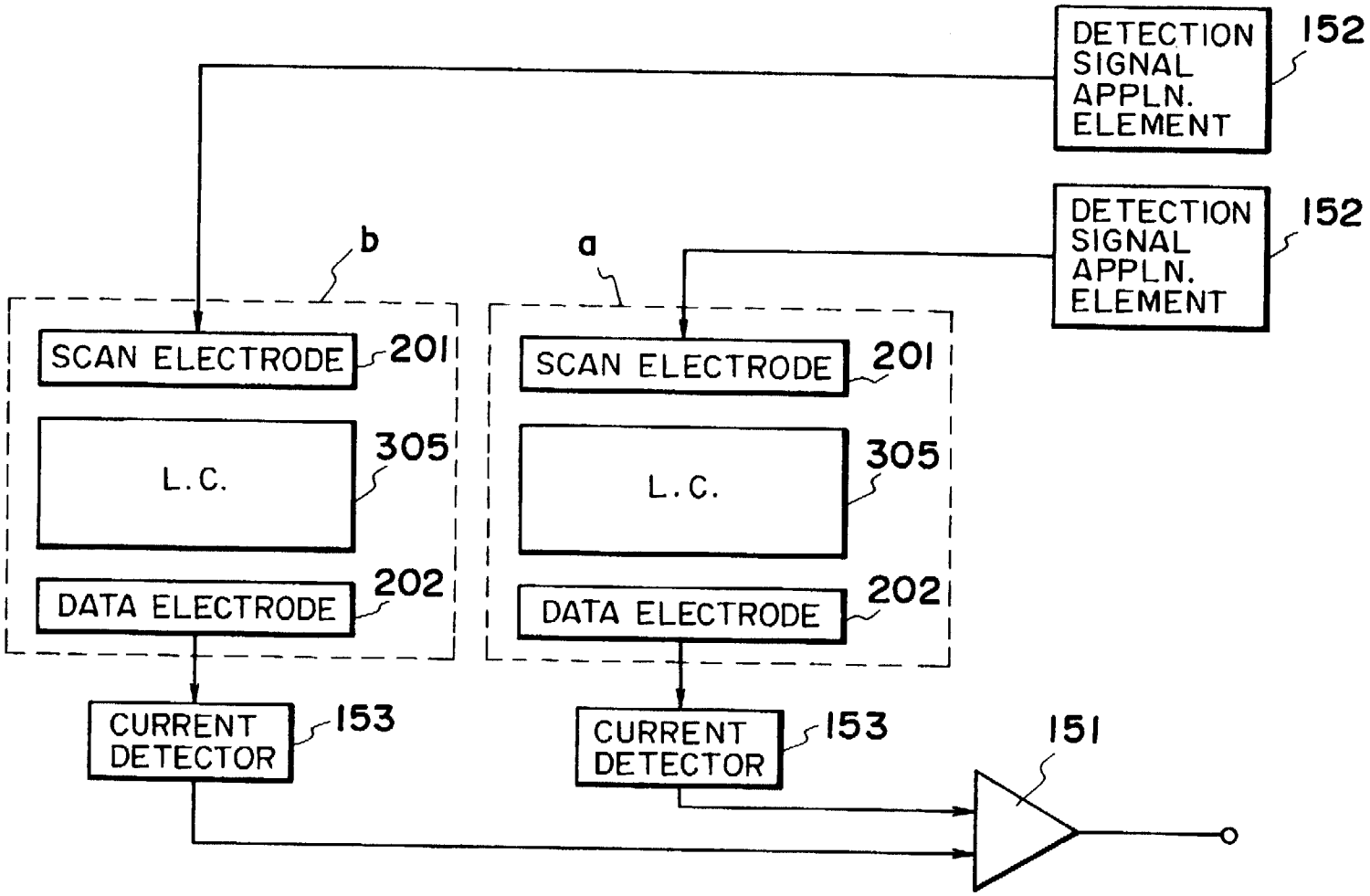
FIG. 13 is a block diagram of a current-detection mechanism used in the invention.

FIG. 13 is a schematic view of a current signal detection system applicable to the display apparatus according to the present invention and usable in association with a control system as shown in FIG. 5.

Different from the one shown in FIG. 3, the system shown in FIG. 13 is used for detection for plural objects (pixels a and b), from which two independent detection output signals are derived.

Referring to FIG. 13, the current signal detection system includes detection waveform application elements 152, current detection elements 153, scanning electrodes 201, data electrodes 202 and a liquid crystal 305. Regions a and b each encircled with a dotted line represent a first and a second detection region each comprising at least one pixel. The current detection system further includes a differential circuit 151 for taking a difference between outputs from the first and second detection regions.

Figure 14A:
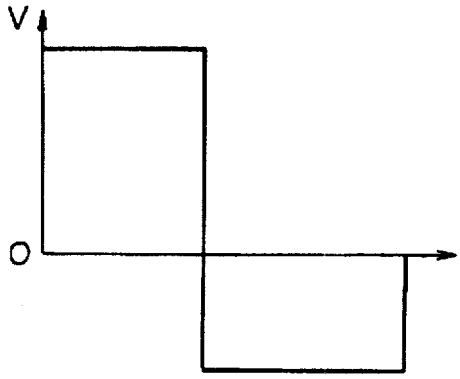
FIGS. 14A–14D are waveform diagrams showing a voltage waveform applied to a liquid crystal device (FIG. 14A) and various detected current waveforms (FIGS. 14B–14D).
Figure 14B:
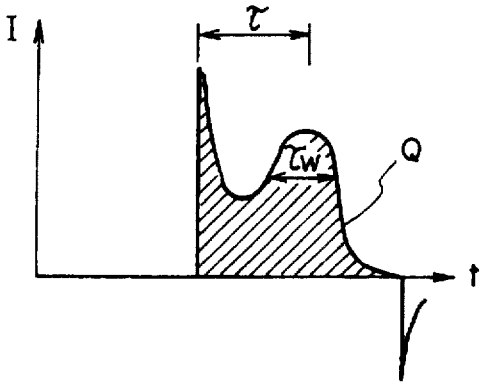

A rectangular or ramp waveform is applied from the detection waveform application circuit 152 to cause a switching of the liquid crystal molecules, thereby detecting an internal current due to inversion of the spontaneous polarization (hereinafter referred to as a "Ps inversion current") by the current detection element 153. For example, when a waveform shown in FIG. 14A is applied, a current response as shown in FIG. 14B may result. As it is known that the shape of a Ps inversion current changes depending on the temperature of the liquid crystal and the electric field intensity, it is possible to know the temperature, cell thickness and threshold characteristic of the detection region (or pixel) by measuring the quantity of charge Q, peak time $\tau$ and half-value width $\tau_w$ of the waveform shown in FIG. 14B.

Figure 14C:
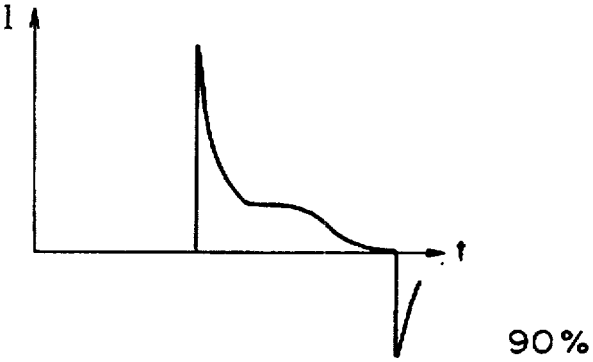
Figure 14D:
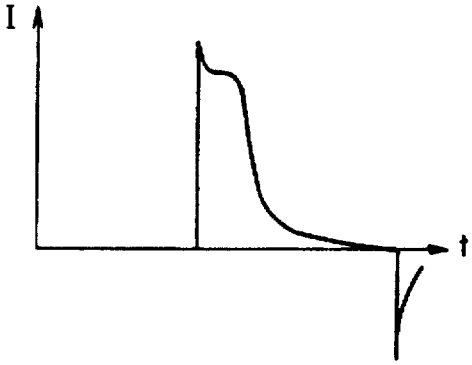

However, the responsive current can further include a charging current accompanying a potential change in the liquid crystal layer, a current accompanying localization of ions in the liquid crystal layer, etc., in addition to the Ps inversion current. Accordingly, in the case of a small Ps inversion current or a quick Ps inversion as shown in FIG. 14C or 14D, respectively, the measured values of the charge quantity Q, peak time $\tau$, half-value width $\tau_w$, etc., are liable to contain increased errors.

Accordingly, after the first detection region (or pixel) a is reset into a white state and the second detection region (pixel) b in a drive condition substantially equal to the first detection region is reset into a black state, then both the first and second detection regions are supplied with a waveform for switching the liquid crystal molecules into a black state. As a result, the Ps inversion current is contained only in the output current from the first detection region and not in the output current from the second detection region. Accordingly, if two outputs are inputted into the differential circuit to take a differential, a Ps inversion current can be obtained.

From the data regarding the Ps inversion current thus obtained, it is possible to know the threshold characteristics, based on which signals applied to the respective pixels may be corrected to effect a stable display.

(EXAMPLE 4)

Figure 15:
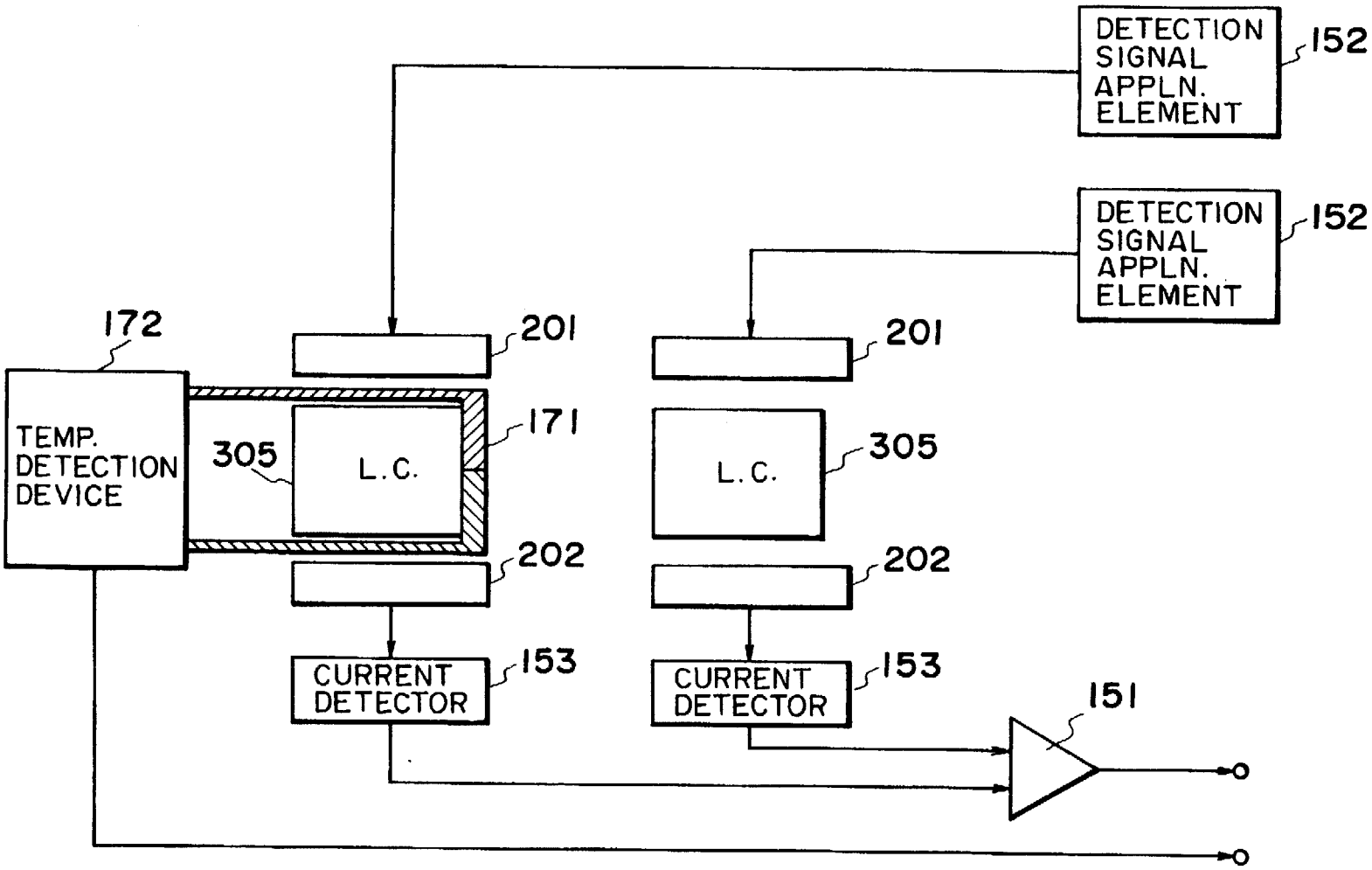
FIG. 15 is a block diagram of a detection means used in the invention.

FIG. 15 is a schematic view of another current signal detection system applicable to the present invention. The system is basically characterized by adding a thermocouple 171 and a temperature detection device 172 to the system shown in FIG. 13.

First, a first detection region and a second detection region in a different condition from the first detection region are both placed in a first state and then supplied with a detection waveform for switching the liquid crystal molecules into a black state. Then, the outputs from the first and second detection regions are inputted into a differential circuit 151 to take a differential. If the first and second detection regions have an equal area and an equal cell thickness, the output of the differential circuit 151 is attributable to a temperature difference between the two detection regions. Now, the temperature of the second (left) detection region is known by the thermocouple 171 and, therefore, can teach the temperature of the first detection region in combination with the output of the differential circuit 151. As in the embodiment of FIG. 13, it is possible to measure the difference in Ps inversion current at a good accuracy by subtracting the contribution of the charging current, the ion current, etc.

As the temperature sensor 171 for the second detection region, it is desirable to dispose a thermocouple of alumel-chromel, chromel-constantan, copper-constantan, etc., within the liquid crystal layer, but it is also possible to dispose a thermister on a glass substrate. The latter is simple in disposition while the accuracy is somewhat inferior.

(EXAMPLE 5)

In some further embodiments, the current signal detection is effected by performing the measurement plural times under different measurement conditions so as to provide different liquid crystal inversion rates, and the correction of an error is effected based thereon. These embodiments may be divided into several types. One embodiment is presented herein as Example 5.

The relationship between the factors such as the Ps inversion current, charging current, ionic current, etc., and the error in measurement values of the charge quantity Q, peak time $\tau$, half-value width $\tau_w$, etc., is the same as in the embodiment of FIG. 13.

In view of a possibility that different liquid crystal molecular states can be present before the measurement, the initial state of a detection region is set in a white state for a first measurement and in a black state in a second measurement, and the detection region is supplied with a detection waveform for switching into a black state in both the first and second measurements. As a result, the output current in the first measurement contains a Ps inversion current whereas the output current in the second measurement does not contain a Ps inversion current, whereby a differential between the two outputs provides a Ps inversion current accompanying the switching from the white state to the black state.

The differential between outputs may be taken by a method of storing the output waveforms in a memory, followed by comparison of the waveforms in memory, or a method of integrating the output waveforms, followed by comparison of the integrated values. The former method provides more detailed information regarding the threshold characteristics but requires a higher cost. On the other hand, the latter method requires only a low cost but can require a long integration period, thus resulting in a slower measurement speed, in some cases.

With reference to FIG. 5 already mentioned for description, an objective pixel for detection (detection pixel) is first reset into a white state by the circuits 103 and 106. Then, the circuit 102 is changed over, and an input signal for switching the pixel into a black state is applied, whereby an output signal thereby is read by the circuit 116. Then, by using the same circuits, the same detection pixel is reset into a black state and then supplied with the same input signal for switching into the black state as in the previous measurement. Then, a differential between the signal thus measured by time-sharing is taken, and display drive signals are corrected based on the differential.

(EXAMPLE 6)

In this embodiment, a number (N) of input signals are applied each after resetting. More specifically, a detection region (or pixel) is initially reset into a white state and then supplied with a detection waveform. This cycle is repeated N times while gradually increasing the pulse width of the detection waveform. As a result, the liquid crystal which may not be switched into black in the first cycle is gradually switched to increase the black state area and make the entire detection region black after the N times of application cycles.

Figure 16:
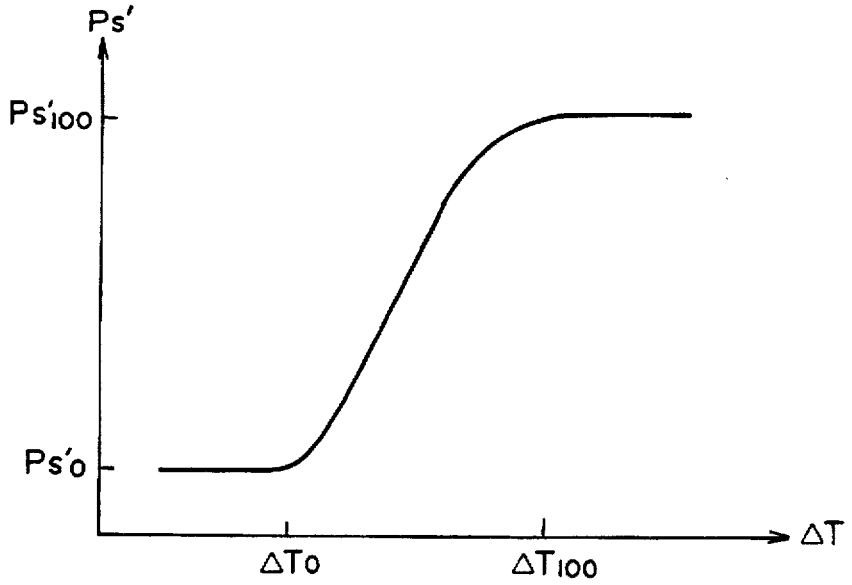
FIG. 16 is a graph showing a relationship between pulse width and Ps inversion current.

FIG. 16 is a graph showing a relationship between pulse width AT and Ps inversion current Ps' based on measured data through such N times of signal application. Generally, the inverted area and the Ps inversion current Ps' correspond to each other. Accordingly, referring to FIG. 16, points giving constant Ps' represented by ($\Delta T_0$, $Ps'_0$) and ($\Delta T_{100}$, $Ps'_{100}$) are used to define inversion rates of 0% and 100%, respectively, and a pulse width-inversion rate characteristic (threshold characteristic) is obtained based thereon.

Display drive may be performed by applying writing waveforms based on such a ΔT-Ps' characteristic.

In the above detection method, the ΔT-Ps' characteristic is obtained by N times of signal application while gradually increasing the pulse width. This is effected for making easy the data processing. For a similar purpose, it is also possible to gradually shorten the pulse width. Reversely, in case of obtaining the ΔT-Ps' characteristic at a time (in a short time) without including a substantial display period during the first to N-th measurements, the pulse widths may preferably be given at random so as to obviate a threshold change due to hysteresis of the liquid crystal inversion state.

A V-Ps' characteristic similar to the ΔT-Ps' characteristic may be obtained by applying pulses having a fixed pulse width and varying voltages. For realization of this, a scanning-side waveform application device capable of providing analog outputs or multi-level outputs, thus requiring a higher cost. However, in the case of gradational display by modulating amplitudes of display data signals, the V-Ps' characteristic provides an advantage of a simple correlation between the detection waveform and the display waveform.

(EXAMPLE 7)

As described above, the response current can contain a charging current in a substantial proportion. In this embodiment, therefore, two measurement periods are provided for a single detection waveform for subtracting the charging current.

Figure 17:
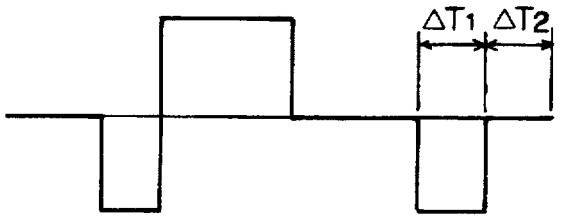
FIGS. 17–21 respectively show a detection signal waveform.

A detection waveform is set as shown in FIG. 17 so as to invert the liquid crystal by a single polarity pulse. A first measurement is performed in a period $\Delta T_1$ for applying the pulse and, in a subsequent period $\Delta T_2$ of an equal length to $\Delta T_1$ immediately after the pulse termination, a second measurement is performed. As a result, the first period $\Delta T_1$ and the second period $\Delta T_2$ include responses to the rising and the falling, respectively, of the same pulse, so that the charging current can be canceled by adding the outputs of the first and second measurements.

In this scheme, it is desired that the inversion of the liquid crystal is completed within a period of $\Delta T_1$ for catching a current response waveform and within a period of $\Delta T_1$–$\Delta T_2$ for catching an integral value of current response.

This embodiment may be effected by applying a control system identical to the one shown in FIG. 8 or 11. A temperature in the vicinity of the display panel is inputted as temperature data to the display signal control circuit 105 and the current detection control circuit 108 via the temperature detection element 109 and the temperature detection circuit 110. The current detection control circuit 108 instructs the detection waveform application circuit 106 to apply appropriate current detection waveforms based on the temperature data. The detection waveforms applied to the liquid crystal display panel 101, and response signals therefrom are received via the signal changeover switches 102 by the current detection circuit 107, through which current data are inputted to the current detection control circuit 108, wherein a differential is taken in this embodiment.

Then, in the display signal control circuit 105, display data received from the graphic controller 112 are converted and corrected based on the above-mentioned temperature data and current data into address data and display data, which are then inputted to the scanning signal application circuit 103 and the data signal application circuit 104, respectively. The scanning signal application circuit 103 and the data signal application circuit 104 respectively apply scanning signals and display signals synchronously to the liquid crystal display panel 101 to effect image display thereon.

On the other hand, as shown in FIG. 11, it is also possible to supply correction data calculated based on the temperature data and current data or the temperature data and the differential of current data to the graphic controller 112, from which already corrected display data is supplied to the display signal control circuit.

(EXAMPLE 8)

Figure 18:
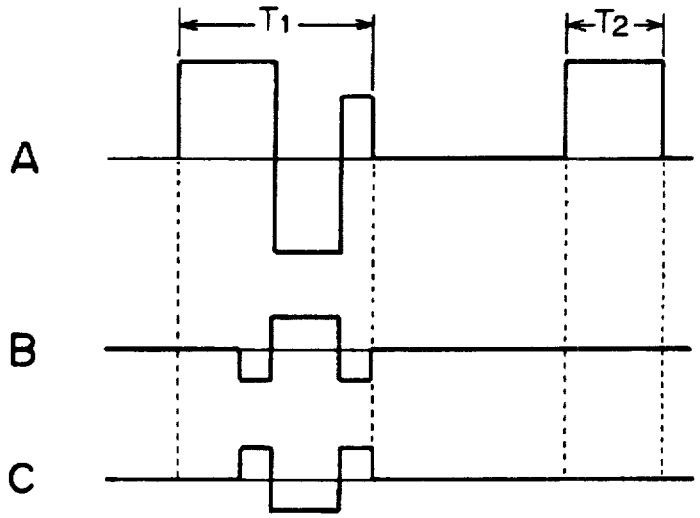

FIG. 18 shows another embodiment of the current detection waveform used in Example 3 or 4. The waveform includes a period $T_1$ for resetting a pixel and a period $T_2$ for current detection. Referring to FIG. 18, at A is shown a (voltage) waveform applied to a scanning electrode, at B is shown a waveform applied to a data electrode for a first detection region, and at C is shown a waveform applied to a data electrode for a second detection region. In the period $T_1$ the first detection region is reset to a white state and the second detection region is reset to a black state. Then, in the period $T_2$ after a pause period of, e.g., 100 μs so as to avoid the influence of the pulse applied in the period $T_1$, an input signal is applied to an associated scanning electrode so as to apply a voltage for switching into a black state to both the first and second detection regions. At this time, current signals outputted from the two data electrodes are read to provide a differential therebetween, based on which display drive signals are corrected.

(EXAMPLE 9)

Figure 19:
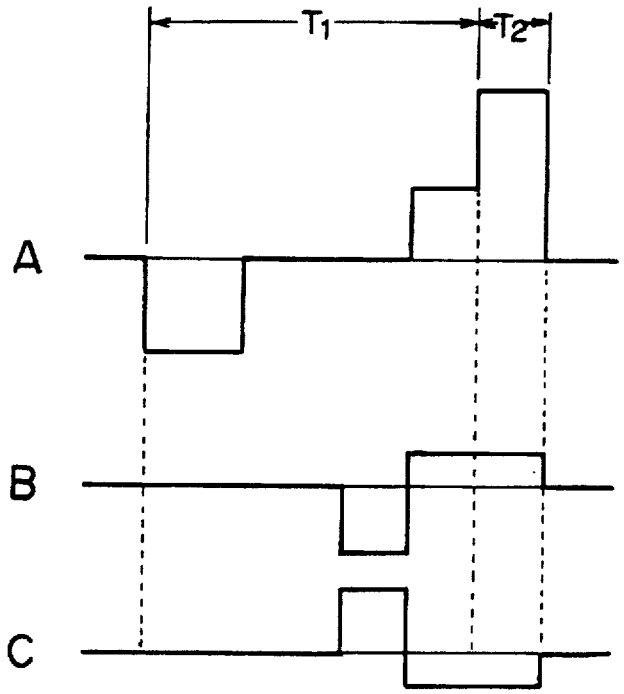

FIG. 19, similarly as FIG. 18, shows another embodiment of the current detection waveform used in Example 3 or 4. Similarly as in FIG. 18, at A is shown a waveform applied to a scanning electrode, at B is shown a waveform applied to a data electrode for a first detection region, and at C is shown a waveform applied to a data electrode for a second detection region. The second detection region is used as a reference for the first data electrode and therefore should desirably be identical to the first detection region with respect to the area as well as the other factors, such as the temperature, cell thickness, and degree of delay in wave transmission, so that the second detection region is disposed in the neighborhood of the first detection region. The first and second detection regions may be set without being fixed but while being changed at locations at prescribed timing for current detection so as not to be localized or biased.

(EXAMPLE 10)

Figure 20:
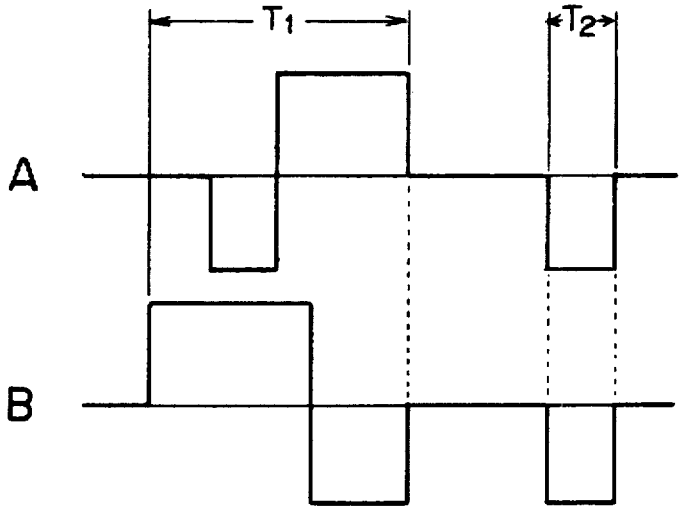

In this embodiment, a current detection system identical to the one shown in FIG. 3 is used by applying waveforms shown in FIG. 20. The waveforms include a period $T_1$ for resetting a pixel and a period $T_2$ for current detection. At A is shown a waveform applied to a scanning electrode for a first measurement, and at B is shown a waveform applied to a scanning electrode for a second measurement. A pixel is reset to a white or black state in the period $T_1$ and set to a black state in the period $T_2$ More specifically, in the first measurement using the waveform at A, a pixel is reset to a white state in the period $T_1$ and, after a prescribed period, inverted to a black state by applying an input signal in the period $T_2$, so that a current signal is detected through a data electrode.

Then, in the second measurement using the waveform at B, the pixel is reset to a black state in the period $T_1$, and, after the same prescribed period, supplied with the same input signal as in the waveform at A in the period $T_2$, so that a current signal is read through the data electrode.

A differential is taken between the current signals obtained in the first and second measurements, and display drive signals are corrected based thereon.

(EXAMPLE 11)

Figure 21:
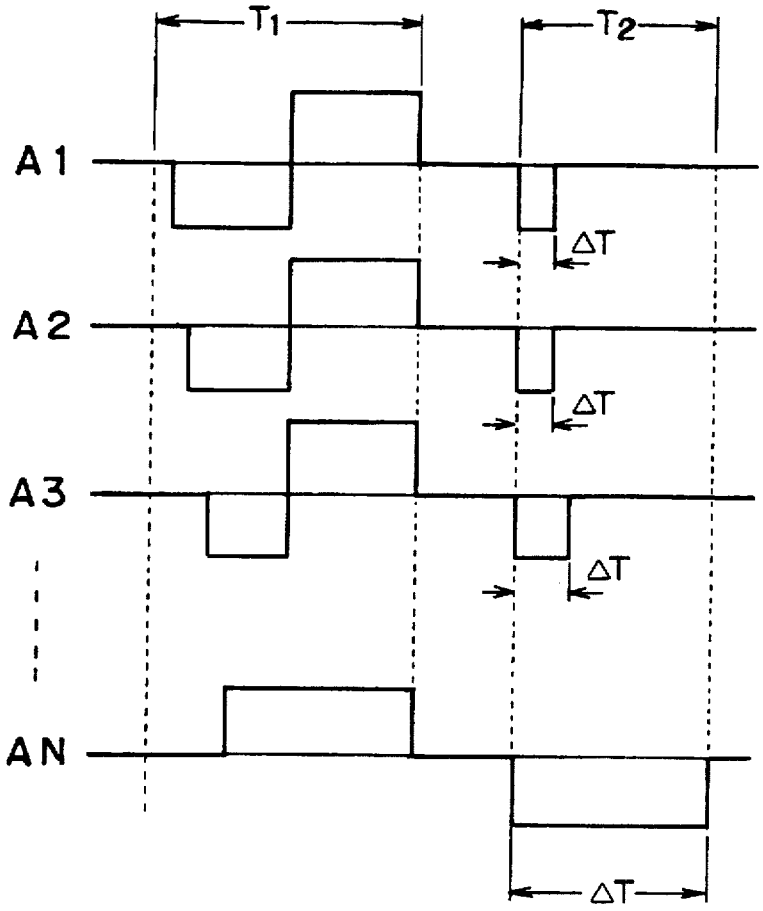

This embodiment is a modification of Example 10 described above and uses a current detection waveform shown in FIG. 21. The waveforms, similarly as those shown in FIG. 20, include a reset period $T_1$ and a detection period $T_2$. Referring to FIG. 21, at $A_1$ is shown a waveform applied to a scanning electrode for a first measurement, at $A_2$ is shown a waveform applied to the scanning electrode for a second measurement, at $A_3$ is shown a waveform applied to the scanning electrode for a third measurement, and . . . at $A_N$ is shown a waveform applied to the scanning electrode for an N-th measurement. For the pulse width $\Delta T$, an initial value and an increment are set based on temperature data, and the pulse width $\Delta T$ is gradually increased as the measurement is repeated from the first, 2nd, 3rd, . . . to the N-th measurement.

(EXAMPLE 12)

Figure 22:
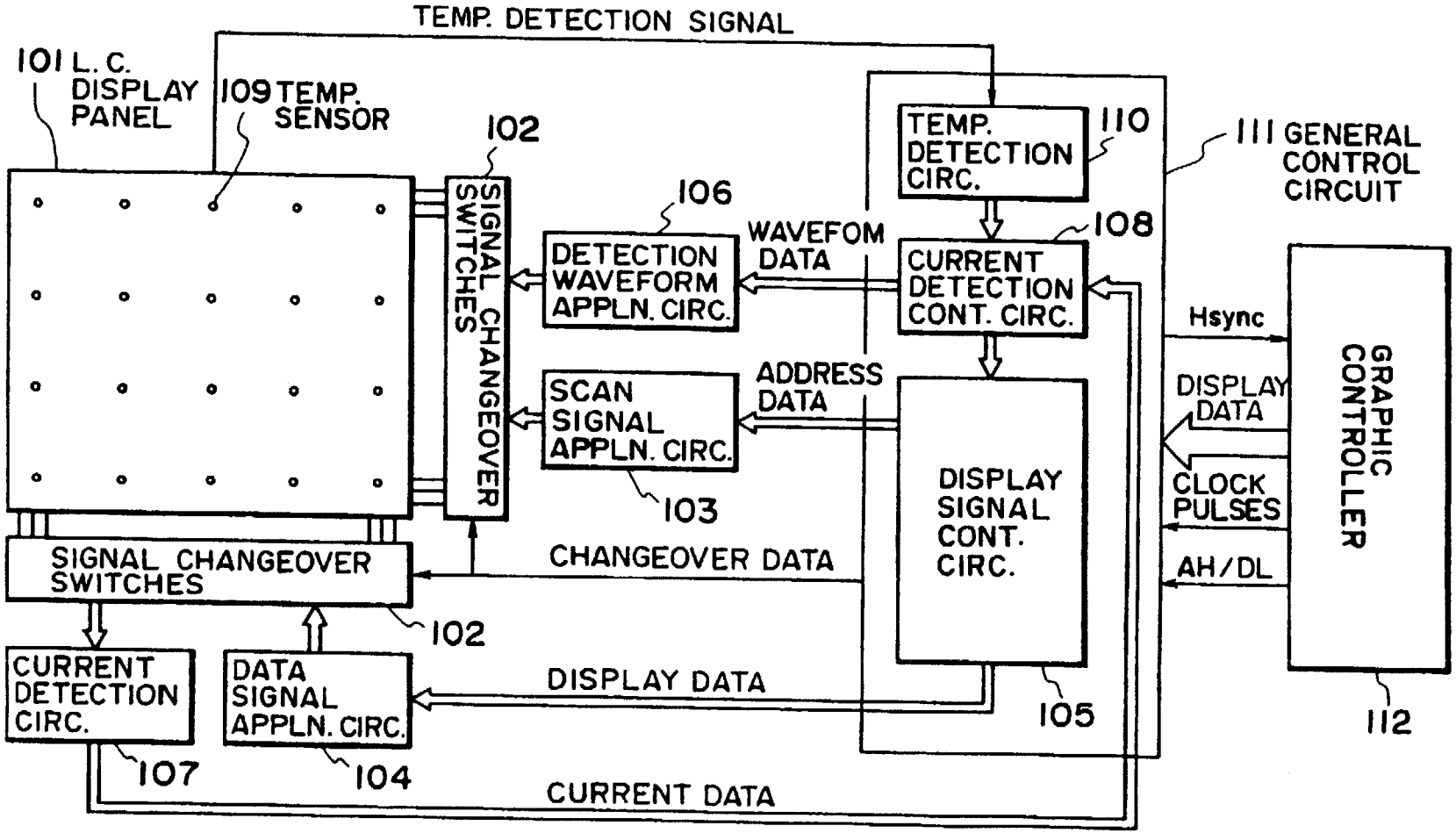
FIG. 22 is a block diagram of another liquid crystal apparatus according to the invention.

FIG. 22 is a block diagram of a liquid crystal display apparatus according to this embodiment including the control system.

Figure 23:
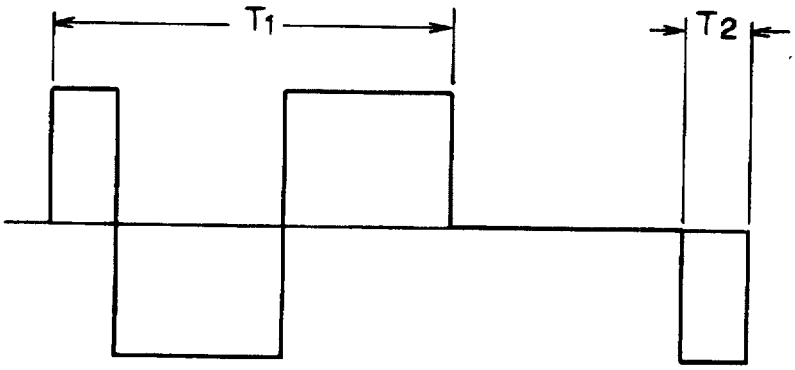
FIG. 23 shows another detection signal waveform used in the invention.

This embodiment is different from the one shown in FIG. 8 in that a large number of temperature sensors 109 are disposed at discrete points on a display panel 101. FIG. 23 shows a detection input signal used in this embodiment including a reset pulse ($T_1$) and an inversion signal ($T_2$) serially applied to scanning electrodes with a prescribed spacing therebetween, so that current signals are taken through associated data electrodes.

(EXAMPLE 13)

Figure 24:
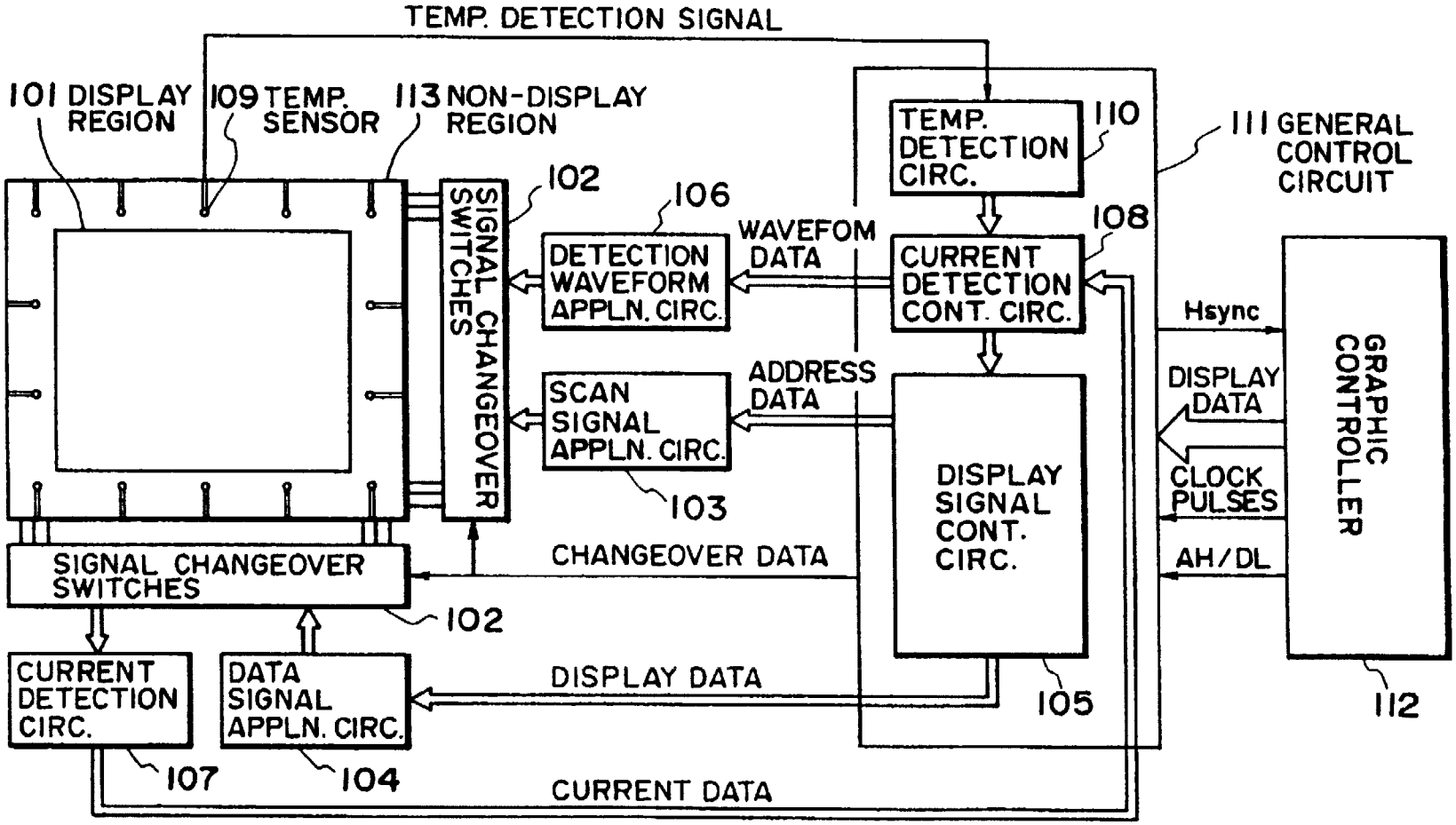
FIG. 24 is a block diagram of still another liquid crystal apparatus according to the invention.

FIG. 24 shows a modification including a modified control system of the liquid crystal display apparatus shown in FIG. 8 or FIG. 22.

In this embodiment, temperature sensors 109 comprising a thermistor are disposed in adhesion on a non-display part 113 (not observable from the outside) of the liquid crystal display panel.

However, as the response current includes not only the Ps inversion current but also a charging current accompanying a potential change within the liquid crystal layer and an ionic current due to localization of ions within the liquid crystal layer, the measured values of the charge quantity Q, peak time $\tau$, half-value width $\tau_w$, etc., can include substantial errors in the case of a small Ps inversion current or a quick Ps inversion as shown in FIG. 14C or 14D.

Accordingly, in this embodiment, a relaxation period is disposed so as to improve the measurement accuracy.

Figure 25:
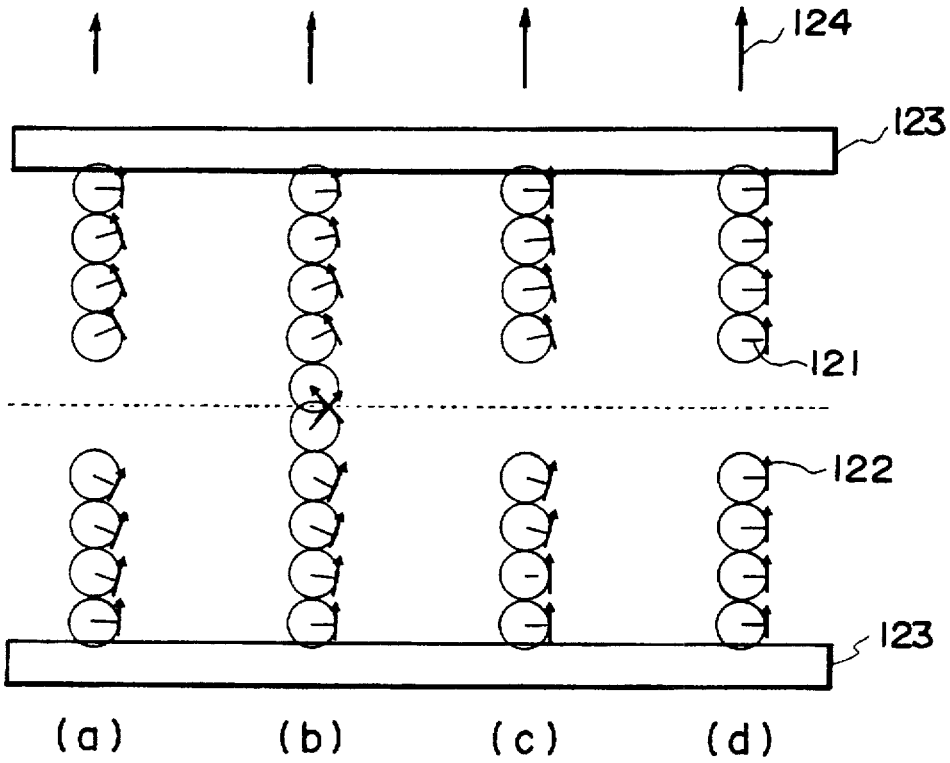
FIG. 25 is a schematic view illustrating an arrangement of liquid crystal molecular directors.

FIG. 25 illustrates how directors of liquid crystal molecules in a uniform alignment state in a chevron structure showing a black display state are changed in response to an applied voltage.

At (a) is shown a state when a minute pulse in a direction of setting a white state is applied, at (b) is shown a state of no voltage application, at (c) is shown a state when a minute pulse in a direction of setting a black state is applied, and at (d) is shown a state when a pulse sufficient to set a back state is applied.

In FIG. 25, each radius 121 represents a director, an arrow 122 represents a spontaneous polarization of a liquid crystal molecule, numerals 123 denote a pair of substrates, and an arrow 124 represents a spontaneous polarization as a total of liquid crystal molecules between the substrates. As shown in the figure, the director directions can be different in the same black state depending on the voltage application states. The spontaneous polarization of each liquid crystal molecule is oriented in a direction perpendicular to the director and is represented by an arrow 122. However, the total spontaneous polarization between the substrates is caused to have a different magnitude which depends on the uniformity of director directions.

In other words, a pixel having an identical inverted domain area can have different quantity of spontaneous polarization depending on the magnitude of a pulse applied or the time since application or termination of a pulse.

Figure 26:
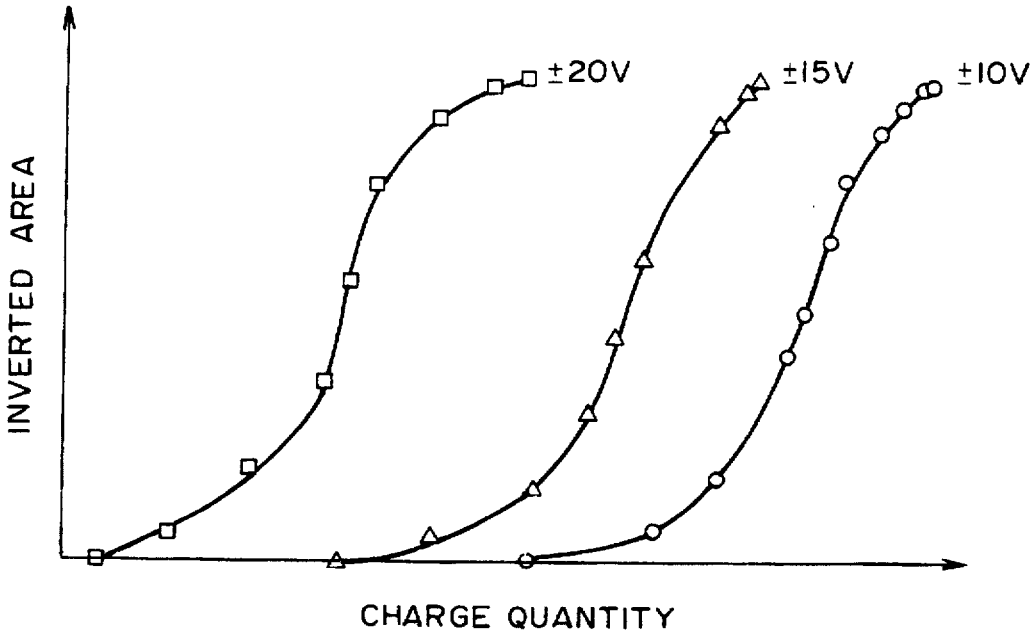
FIGS. 26 and 28 are respectively a graph showing a relationship between charge and inverted area.

FIG. 26 is a graph showing a relationship between inverted domain area and charge quantity in case where a pixel comprising a liquid crystal used in this embodiment is changed from its initial black state to a halftone state by application of a pulse so that the charge quantity is determined as a difference in charge quantity between immediately before and after application of the pulse. FIG. 26 shows the results obtained by applying drive voltages of +10 volts, ±15 volts and ±20 volts. As shown, the characteristics are clearly different depending on the drive voltages applied.

For the above reason, in order to obviate the error in measurement of a spontaneous polarization, it is appropriate that the current detection is performed with reference to a constant director state, i.e., the no voltage application state shown at FIG. 25(*b*) or the largest spontaneous polarization state shown at FIG. 25(*d*).

Accordingly, it is appropriate to dispose a relaxation period after a pulse application so as to effect a measurement when the influence of the pulse is removed, or to effect a measurement during or immediately after application of a sufficiently large pulse (reset pulse). Further, in order to obtain a varying domain area, it is necessary to applying a pulse for placing a pixel in a halftone state. Accordingly, measurement may appropriately be effected by using a combination of "a halftone pulse+a relaxation period" and "immediately after application of a reset pulse".

For the above reason, the current response is measured by using a group of waveforms as shown in FIG. 26. In FIG. 26, $T_1$ denotes a period for applying a first waveform for setting a pixel in a halftone state. $T_2$ denotes a relaxation period wherein the director moved by application of the first waveform is set in the state shown at FIG. 25(*b*). $T_3$ denotes a period for applying a second waveform by which the pixel is reset to a black state. The directors immediately after the application of the second waveform are in the state shown at FIG. 25(*d*). Accordingly, a charge quantity difference between the points immediately before and immediately after application of the second waveform. FIG. 28 shows a relationship between the domain area inverted into the black state by application of the second waveform and the charge quantity (difference) thus measured, under different drive voltages of ±10 volts, ±15 volts and ±20 volts for the first and second waveforms while changing the pulse widths (FIG. 27(*a*) to FIG. 27(*d*)) so as to provide various inverted domain areas. As shown in FIG. 28, a good agreement is obtained among the drive voltages of ±10 volts, ±15 volts and ±20 volts, thus showing a constant relationship between the inverted domain area and the Ps inversion current (i.e., charge quantity as an integrated value).

Figure 28:
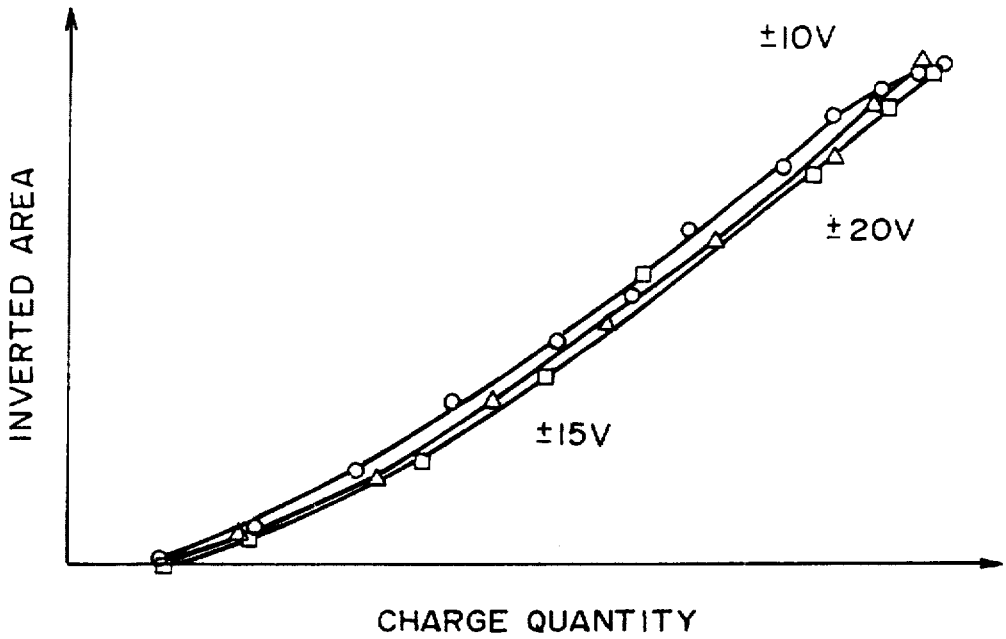
Figure 29:
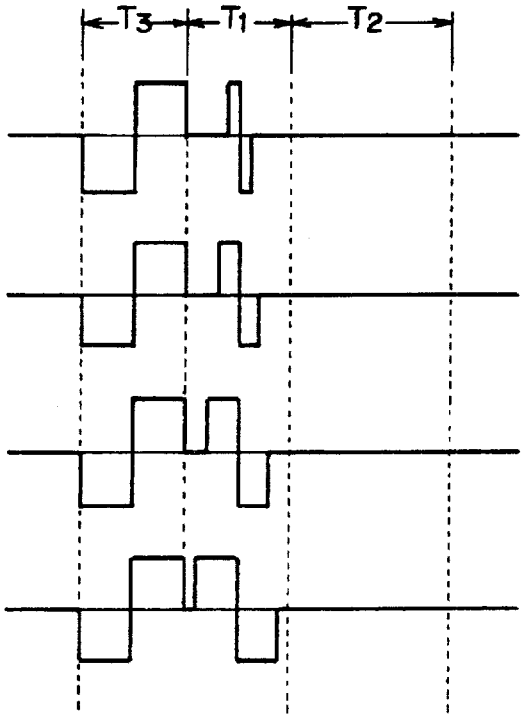

FIG. 29 shows another group of waveforms for such measurement. $T_3$ is a period for applying a second waveform for resetting a pixel to a black state. $T_1$ is a period for applying a first waveform for setting the pixel in a halftone state, and $T_2$ is a relaxation period. A relation similar to the one shown in FIG. 28 is obtained by taking a charge quantity (difference) between the points immediately after the application of the second waveform and after the relaxation period. However, compared with the scheme using the waveforms shown in FIG. 27, a longer period is required for the current detection, so that the measurement result is liable to be accompanied with a noise by that much.

Figure 27:
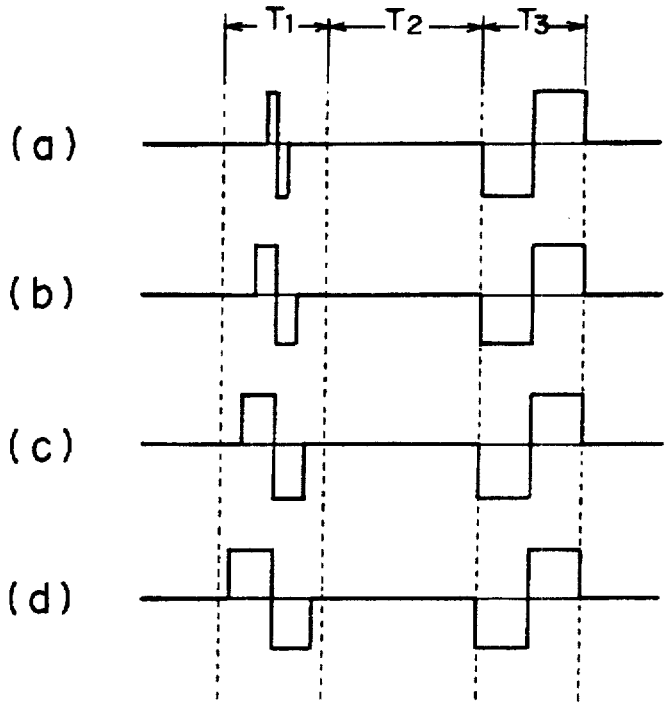
FIGS. 27 and 29 respectively show a detection signal waveform.

In the above, in order to obtain the state shown at FIG. 25(*b*), it is desirable to design the first waveform and the second waveform to be free from DC components as shown in FIG. 27 or 29.

The periods required of $T_1$, $T_2$ and $T_3$ vary depending on the temperature and drive voltages, and the period $T_1$ can also vary depending on the halftone level to be displayed. At 30° C. and under application of ±20 volts, for example, a uniform display could be obtained by roughly $T_1$=200 μs, $T_2$=300 μs, and $T_3$=200 μs. At higher temperatures, the respective periods could be shortened but $T_2$ required 100 μs at the minimum for a uniform display.

As described above, it is possible to provide a liquid crystal display apparatus capable of stably retaining a good display state regardless of a temperature change and a threshold distribution along a liquid crystal display panel by providing current detection means and means for applying two waveforms with a relaxation period for current detection.

(EXAMPLE 14)

As the shape of Ps inversion current varies depending on the temperature, the shape of a detection waveform, etc., it is possible to know the temperature, cell thickness and threshold characteristic at a detection region from the charge quantity, peak time, etc. A threshold change may be obtained by comparing the threshold characteristic with a reference threshold characteristic, and a correction factor may be obtained therefrom within a pause period during or in parallel with image display drive. During the display drive, given display data are corrected by adding correction factors for respective pixels concerned, thereby controlling the drive signals applied to the respective electrodes.

Figure 30:
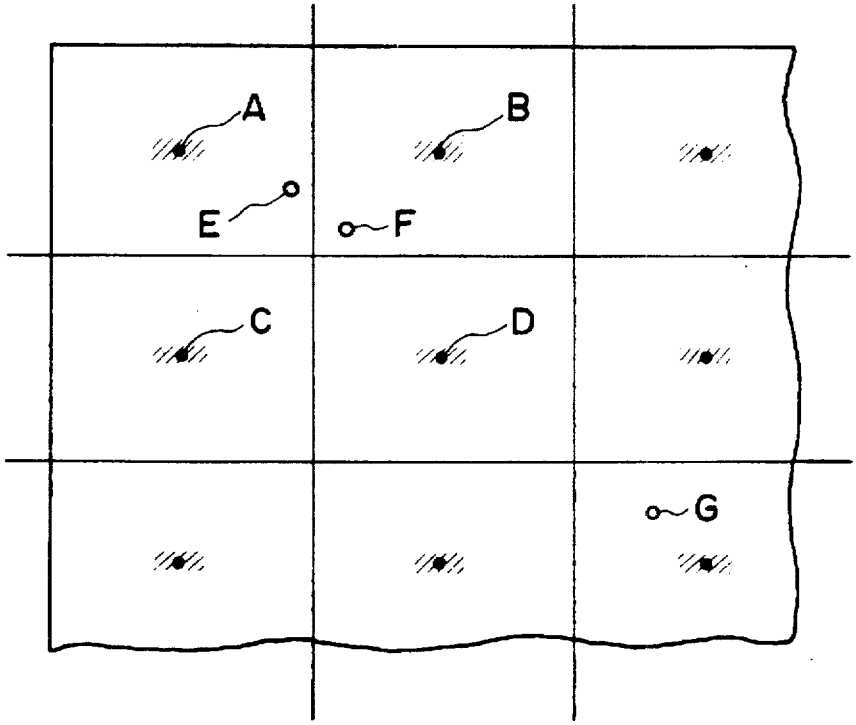
FIG. 30 is a schematic plan view of a display section of a liquid crystal display apparatus according to Example 14 appearing hereinafter.

FIG. 30 is partial plan view of a display panel used in this embodiment, wherein a detection region is denoted by hatching and a black spot represents a center of a related detection region.

Display compensation may for example be performed in such a manner that a display panel is divided into an appropriate number of sections as shown and a common correction factor is used for each section. For example, a display at point E is corrected by using a correction factor at point A and a display at point F is corrected by using a correction factor at point B. According to this scheme, however, the correction factors in the vicinity of section boundaries are discontinuous, so that there arises a difficulty of providing two different display states for identical display data.

In order to obviate such an irregularity at such section boundaries, it is preferred that correction factors obtained from current data at respective detection regions are used for deriving correction factors over the entire display area.

For example, a correction factor Mx for a point E surrounded by four points A, B, C and D may be calculated by interpolation based on the following formula 1 or 2:

$$Mx = \frac{(M_1+M_2+M_3+M_4)(L_1+L_2+L_3+L_4) - (M_1L_1+M_2L_2+M_3L_3+M_4L_4)}{3(L_1+L_2+L_3+L_4)}, \quad \text{Formula 1}$$

or $$Mx = \frac{M_1L_2L_3L_4 + L_1M_2L_3L_4 + L_1L_2M_3L_4 + L_1L_2L_3M_4}{L_2L_3L_4 + L_1L_3L_4 + L_1L_2L_4 + L_1L_2L_3}, \quad \text{Formula 2}$$

wherein $M_1$–$M_4$ denote correction factors for points A–D, respectively, and $L_1$–$L_4$ denote distances between the point E and the points A–D, respectively.

Generally, the correction factor My for an arbitrary point may be calculated by interpolation by using corrections factors $M_1 \ldots . Mn$ of an appropriate number (n) of points having distances $L_1 \ldots Ln$, respectively, from the arbitrary point based on the following formula 3 or 4:

$$My = \frac{\sum_{i=1}^{n} Mi \sum_{j=1}^{n} Lj - \sum_{i=1}^{n} MiLi}{(n-1)\sum_{i=1}^{n} Li}, \quad \text{Formula 3}$$

or $$My = \frac{\sum_{i=1}^{n} (Mi/Li)}{\sum_{i=1}^{n} (1/Li)}. \quad \text{Formula 4}$$

The number n is at most the number S of detection regions set on the display panel and should be an appropriate number of detection points in the neighborhood of the objective arbitrary point.

In some cases, it is desirable to effect interpolation with respect to time. For example, if a correction factor for a point G changes rapidly or periodically, the display state of the corresponding pixel can also cause a rapid contrast change or flicker. In such a case, the change in correction factor may be moderated by interpolation. For example, if the correction factor for the point G is M at time $T_1$ and then 10M at a subsequent current detection, the correction factor for the point G is gradually changed to 2M, 3M, . . . 10M at time $T_2$, $T_3$, . . . $T_{10}$.

As described above, a good display can be ensured by interpolation with respect to position and time, so that the current detection need not performed at every pixel or frequently and thereby the cost for the current detection can be saved by minimizing the time and space for the current detection.

In a specific example, a display panel having 1280×1024 pixels was provided with 2500 detection regions each comprising 10 pixels (5 pixels along a scanning electrode and 2 pixels along a data electrode). The correction factors for respective pixels were calculated by interpolation based on the formula 3 using correction factors from the surrounding detection regions within a display control circuit in parallel with control of the drive signals while changing a correction factor once per 0.5 sec (interpolation at a 0.5 sec cycle) based on current detection data obtained once per 5 sec at the respective detection regions.

As described above, according to this embodiment, it is possible to retain a good display state over an entire display panel regardless of a threshold change while suppressing a rapid or discontinuous change or flicker accompanying the compensation.

(EXAMPLE 15)

In order to effect a good display and further a stable halftone display on a large display panel regardless of a temperature distribution thereover, it is necessary to effect an accurate compensation for a threshold irregularity over the display panel. Therefore, an apparatus according to this embodiment is provided with means for detecting a threshold characteristic of a certain specific region (data electrode) on the matrix display panel, i.e., means for detecting charge migration accompanying an inversion from a first stable state to a second stable state or vice versa of liquid crystal molecules in the detection region, and means for correcting data signals and scanning signals based thereon.

In order to accurately detect the charge migration, the following factors are important:

1) Molecules in a detection region are inverted.

2) The migrated charge or a part thereof accompanying the detection ("responsive current") can be taken out to a current detection circuit outside the electrode matrix.

3) Responsive current other than from the detection region does not enter the current detection circuit.

Based on the above, in order to accurately measure the detection current while avoiding image quality degradation, this embodiment is characterized by the following features.

Figure 31:
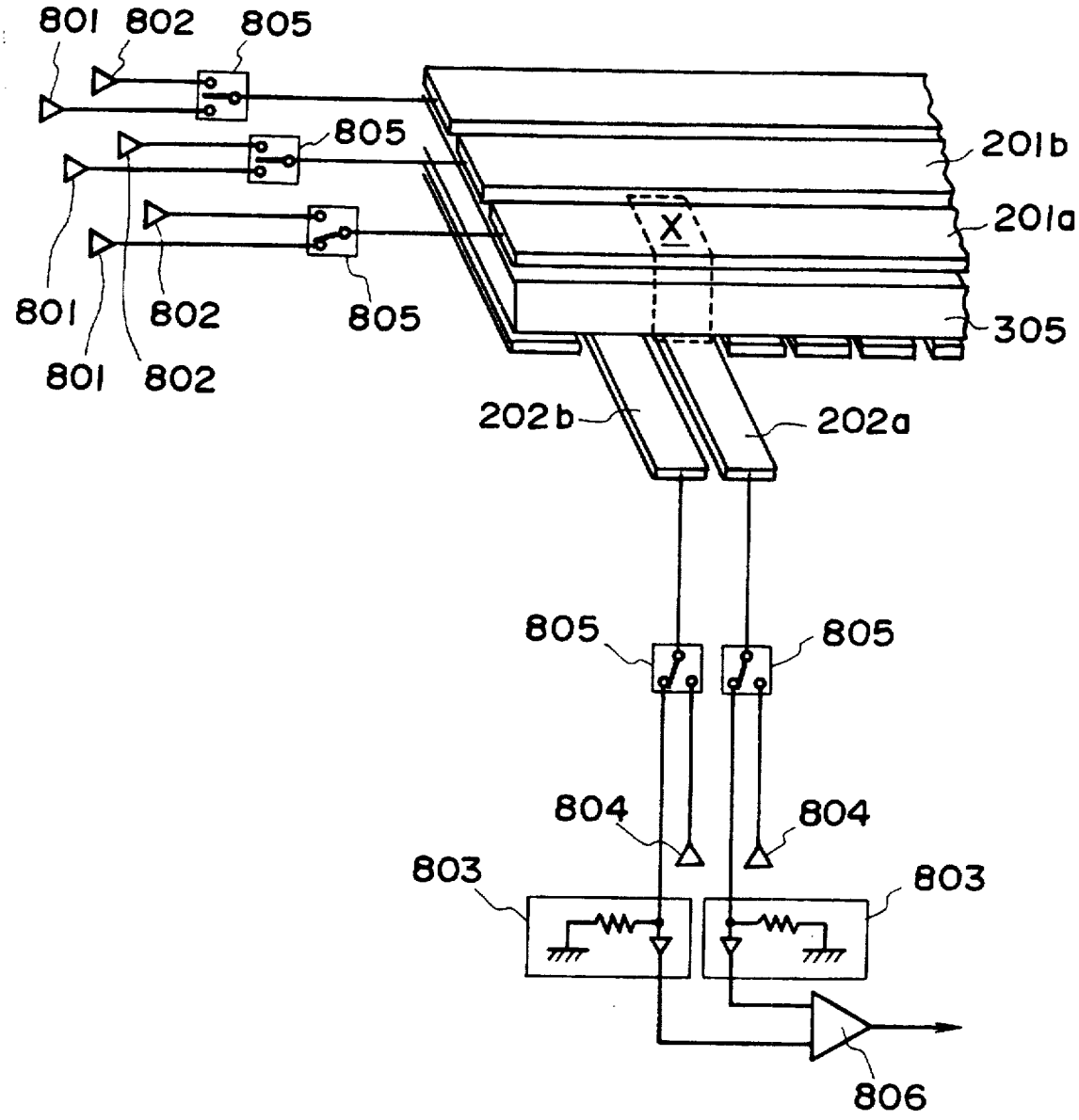
FIG. 31 is a schematic illustration of a liquid crystal display apparatus according to Example 15.

FIG. 31 is a schematic illustration of a detection system according to this embodiment. Referring to FIG. 31, the system includes a detection waveform application circuit 801, a scanning signal application circuit 802 for display drive, a current detection circuit 803 including an amplifier and a terminal resistor, a data signal application circuit 804 for display drive, switches 805 for changeover between detection operation and display drive, and a differential circuit 805. These members are connected to a liquid crystal display panel including scanning electrodes 201*a*, 201*b*, . . . , data electrodes 202*a*, 202*b*, . . . and a ferroelectric liquid crystal 305 disposed between the scanning electrodes and data electrodes. A detection region may be formed as a region x encircled by a dotted line.

In the detection operation, the switches 805 are set to a position for detection, and a detection waveform as shown in FIG. 4A is applied from the detection waveform application circuit 801 to the scanning electrode 201*a* to switch the liquid crystal molecules in the detection region X, whereby a response current (FIG. 4B) including a Ps inversion current is inputted to the current detection circuit 803 via the data electrode 202*a*. As it is known that the shape of a Ps inversion current changes depending on the temperature of the liquid crystal and the electric field intensity, it is possible to know the temperature, cell thickness and threshold characteristic of the detection region (or pixel) by measuring the quantity of charge Q, peak time $\tau$ and half-value width $\tau_w$ of the waveform shown in FIG. 4B.

Figures 32A, 32B, 32C:
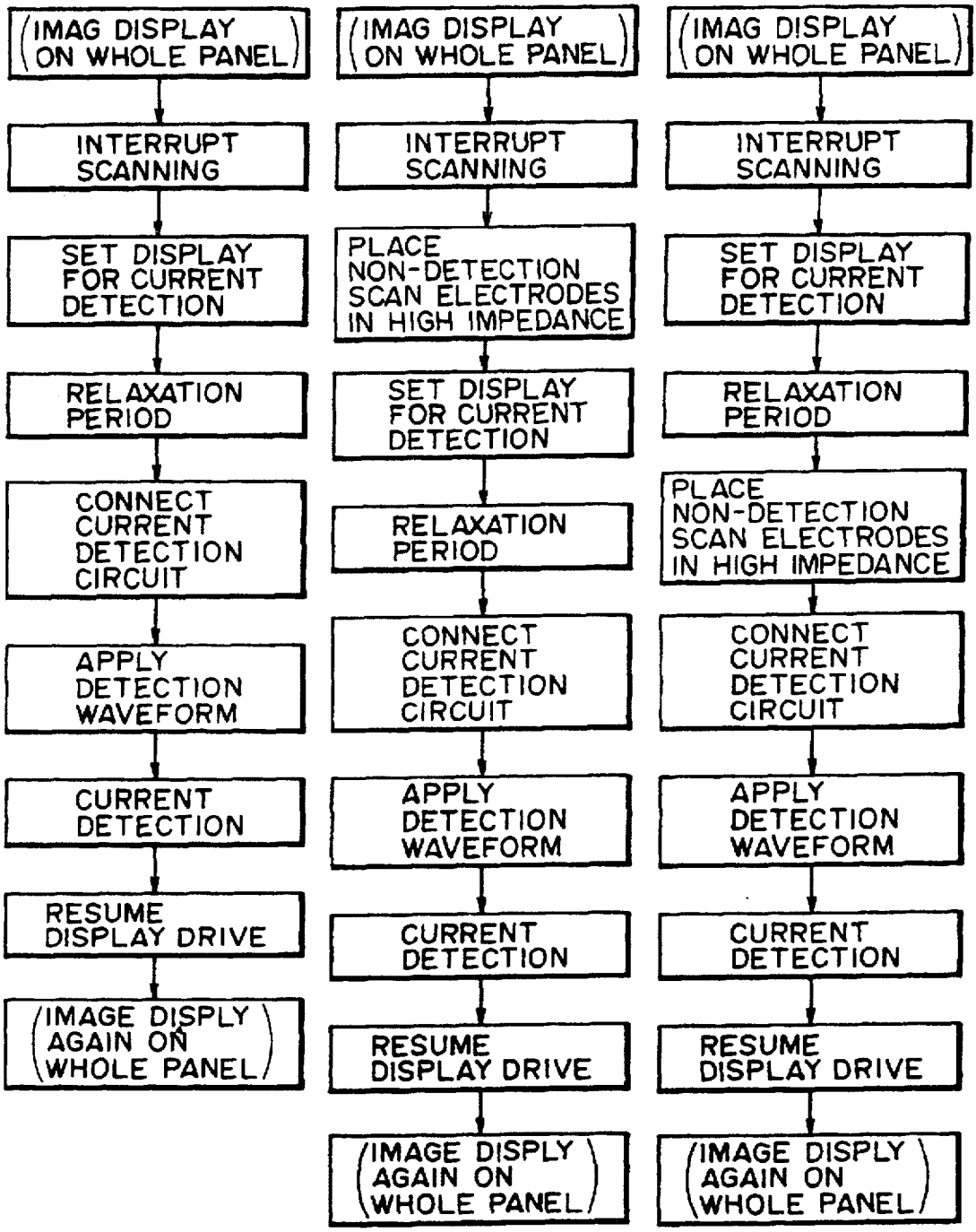
FIGS. 32A–32C are flow charts showing three modes of operation of the liquid crystal display apparatus according to Example 15.

In order to prevent the response current from outside the detection region from entering into the current detection circuit, the image display operation is switched to the current detection operation in a step within a sequence shown in FIG. 32A so as to cause the inversion of liquid crystal molecules only at the detection region. More specifically, the sequence includes the following steps.

1) The scanning for image display drive is interrupted. As a result, a static picture is displayed because of the memory characteristic of the ferroelectric liquid crystal.

2) Pixels including the detection region (at least one pixel) on a scanning electrode concerned are written. At this time, the pixel in the detection region is in a first stable state or a mixture of the first stable state and a second stable state, and pixels outside the detection region are reset to the second stable state.

3) The pixels are allowed to stand until the molecular perturbation or perturbation due to the writing at 2) is substantially removed (a relaxation period is disposed).

4) Associated data electrodes are connected to the current detection circuit to start the current detection.

5) the scanning electrode (detection-selection scanning electrode) including the detection region is supplied with a detection waveform to reset all the molecules in the detection region to the second stable state.

6) The response current is detected.

7) After the current detection, the display drive is resumed by first scanning the detection-selection scanning electrode to form an image.

By performing the steps 1)–7) above sequentially, the liquid crystal molecules in the detection region can be selectively switched into the second stable state.

Data electrodes not related with the detection region or a region for a differential purpose as described below may be provided with a ground level potential from the data signal application circuit 804 or grounded via the terminal resistor so as to suppress the noise, thereby providing an increased S/N ratio.

The response current occurring in the detection region enters the current detection circuit 803 via the data electrode. However, a part thereof can flow to the scanning electrode side during the period it flows through the data electrode.

Accordingly, at the time of the current detection, scanning electrodes not associated with the detection region (detection-nonselection scanning electrodes) may be placed in a high impedance state so as to remove a potential difference from the opposite data electrodes, thereby preventing the response current from flowing toward the scanning electrode side. As a result, the detection current entering the current detection circuit may be increased. Examples of the current detection sequence including such a high impedance placement step are shown in FIGS. 32B and 32C.

Incidentally, in case where data electrodes not associated with the detection region are grounded via a resistor, a response current is inputted to the current detection circuit; in case where such non-associated pixels are grounded, substantially identical to the integral value of the response current is inputted to the current detection circuit and, in case where such non-associated data electrodes are placed in a high impedance state, a potential almost identical to that of the scanning electrode side is inputted to the current detection circuit. The former two cases are more effective.

Figure 33:
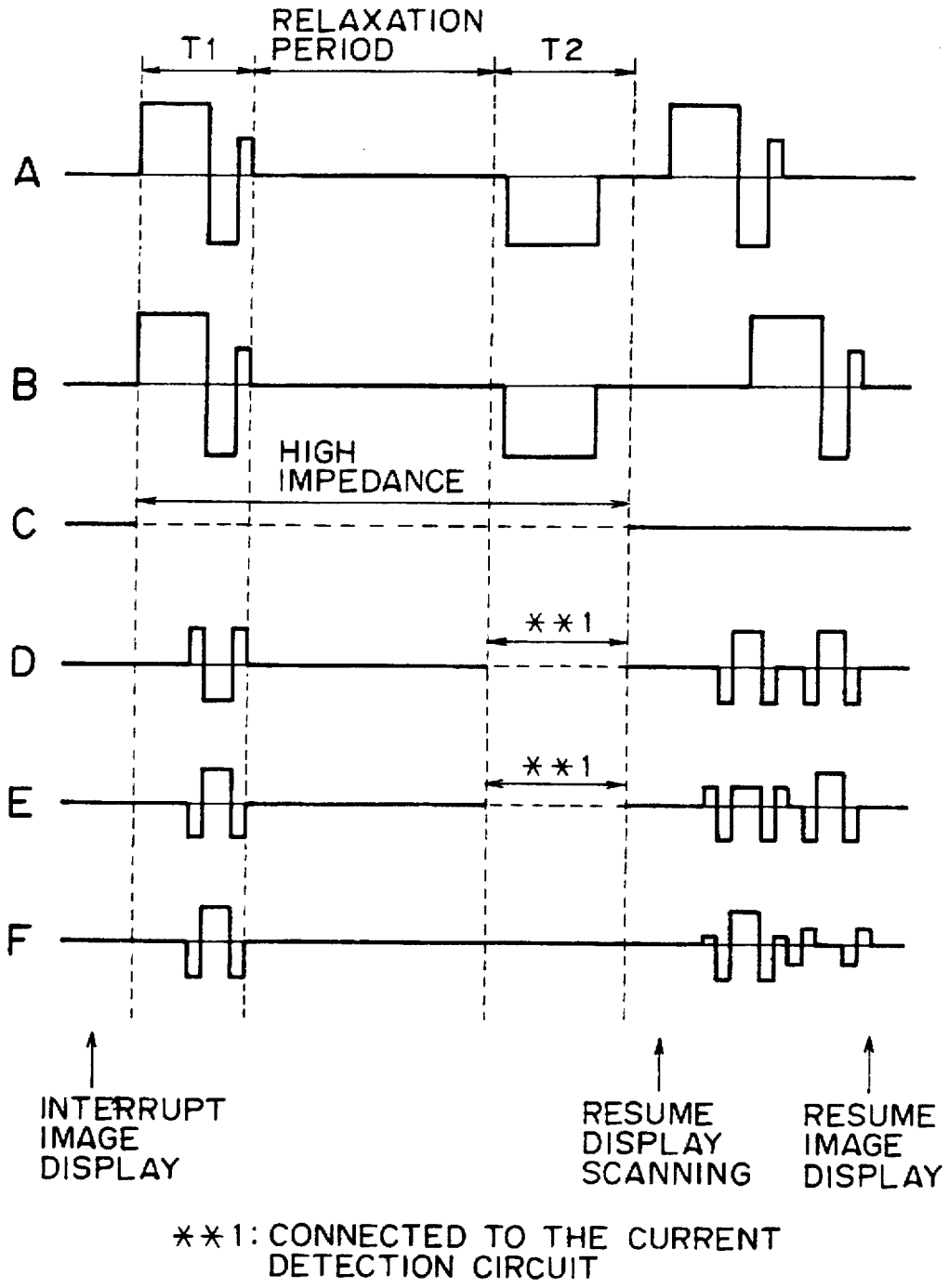
FIGS. 33 and 34 are time-serial waveform diagrams showing detection input signals used in Examples 15 and 16, respectively.

FIG. 33 is a time-serial waveform diagram showing a set of waveforms for current detection. The waveforms include a period $T_1$ for resetting the liquid crystal molecules into a state suitable for current detection, a period $T_2$ for current detection and a relaxation period therebetween. Referring to FIG. 33, at A and B are shown waveforms applied to detection-selection scanning electrodes, at C is shown a waveform applied to detection-nonselection scanning electrodes, at D is shown a waveform applied to data electrodes associated with (i.e., constituting) the detection region, at E is shown waveform applied to data electrodes associated with a detection region for a differential purpose, and at F is shown a waveform applied to data electrodes not associated with (i.e., not constituting) the detection region.

In the period $T_1$, the detection region is set to a first stable state or a mixture of the first stable state and a second stable state, and the pixels outside the detection region on the detection-selection scanning electrode(s) are reset to the second stable state.

In the period $T_2$ following the relaxation period, all the pixels on the detection selection scanning electrode(s) are reset to the second stable state for current detection at the pixels constituting the detection region. After the current detection, the scanning for image display is resumed from the detection-selection scanning electrode(s) to resume an image display state within 2 ms.

In this instance, in order that the image disorder due to the current detection is not recognizable by eyes, the second stable state may preferably be set to an optical state close to a display state immediately before the detection. For example, in case where a current detection is performed during display of a picture having a bright state as the background, it is preferred that the second stable state is set to a bright state.

Further, a region for taking a differential with the detection region may preferably have factors, such as area, temperature, cell thickness, and a delay in waveform transmission, affecting the current response identical to those of the detection region and is therefore preferably set at a position close to the detection region.

In a specific example, a detection region was set to include 10 pixels (5 pixels along each scanning electrode and 2 pixels along each detection region), and the current detection was performed while setting $T_1$ at 150 μs, the relaxation period at 1.5 ms, $T_2$ at 100 μs and a display restoring period at 200 μs (corresponding to two lines), so as to suppress the image display interruption period within 2 ms, whereby no image disorder was visually recognized.

(EXAMPLE 16)

Figure 34:
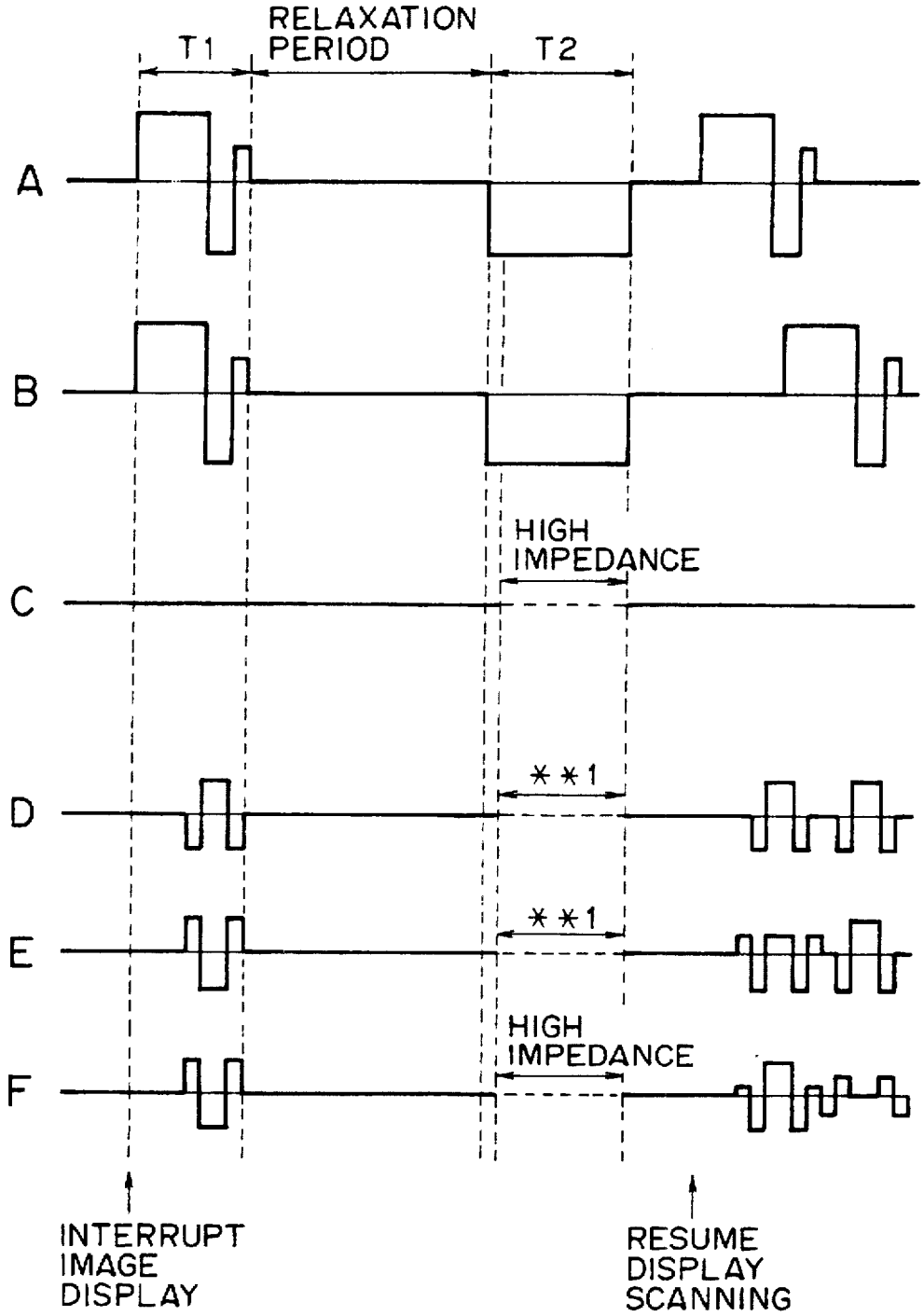

FIG. 34 is a time-serial waveform diagram showing a set of waveforms used for current detection in another embodiment. This embodiment is different from the embodiment shown in FIG. 33 in that the detection non-selection scanning electrodes and data electrodes not associated with the detection region are all placed in a high-impedance state during current detection, and the period of connecting the data electrodes for detection to the detection circuit is restricted to within the detection pulse-application period. The connection may be effected at any time after application of the detection pulse and before commencement of the polarity inversion of the liquid crystal. The disconnection from the detection circuit and connection to the display drive circuit may be at any time after completion of the polarity inversion.

In a specific example, the connection to the detection circuit was performed at a point of 10 μs after application of the detection pulse, and the disconnection was performed simultaneously with the termination of the detection pulse. The detection-nonselection scanning electrodes and data electrodes not associated with the detection region were placed in a high-impedance state simultaneously with the connection of the associated data electrodes to the detection circuit.

In the embodiment of FIG. 13, the associated data electrodes are connected to the detection circuit prior to the application of the detection pulse and are thus placed in a high-impedance state, so that the potential of the data electrodes is also affected by the application of the detection pulse and is restored to zero potential through the terminal resistor within the detection circuit, thus applying a voltage to the liquid crystal. For this reason, the voltage application can be delayed substantially depending on the magnitude of the terminal resistor, thus taking a longer time for the detection.

In contrast thereto, if the connection to the detection circuit is effected immediately after the application of the detection pulse as in this embodiment of FIG. 34, the liquid crystal is supplied with the voltage simultaneously with the pulse application, so that the detection time can be shortened and the terminal resistor can be omitted.

(EXAMPLE 17)

Figure 35:
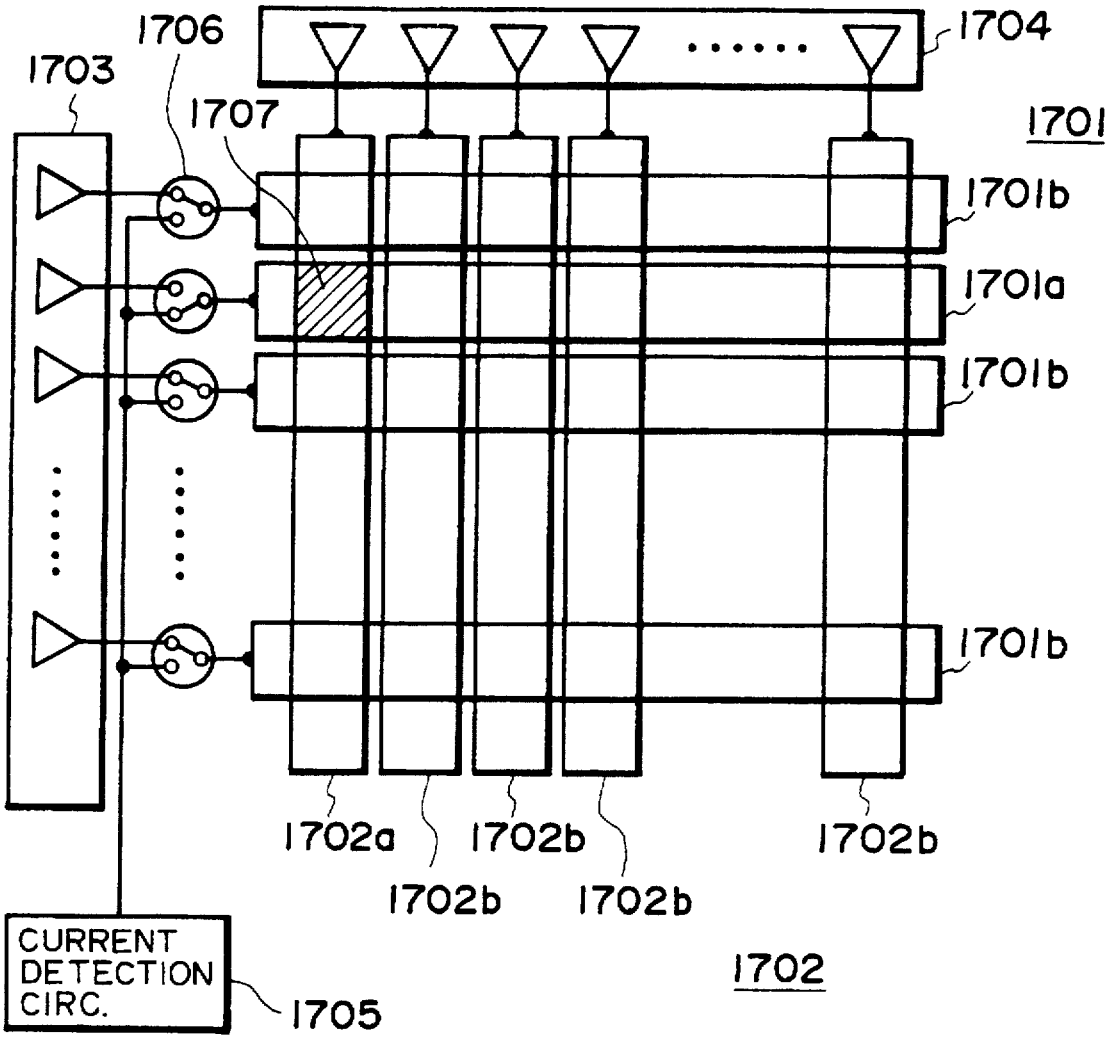
FIG. 35 is a schematic illustration of a liquid crystal display apparatus used in Example 17.

FIG. 35 is a block diagram showing a liquid crystal display apparatus including a current detection system according to this embodiment. Referring to FIG. 35, the system includes scanning electrodes 1701 including a scanning electrode 1701*a* associated with a detection region 1707 and scanning electrodes 1701*b* not associated with the detection region, data electrodes 1702 including a data electrode 1702*a* associated with the detection region and data electrodes 1702*b* not associated with the detection region, a scanning electrode drive circuit 1703, a data electrode drive circuit 1704, a current detection circuit 1705, and changeover switches 1706 for switching the connection of the scanning electrodes to the drive circuit 1703 or to the detection circuit 1705.

Figure 36:
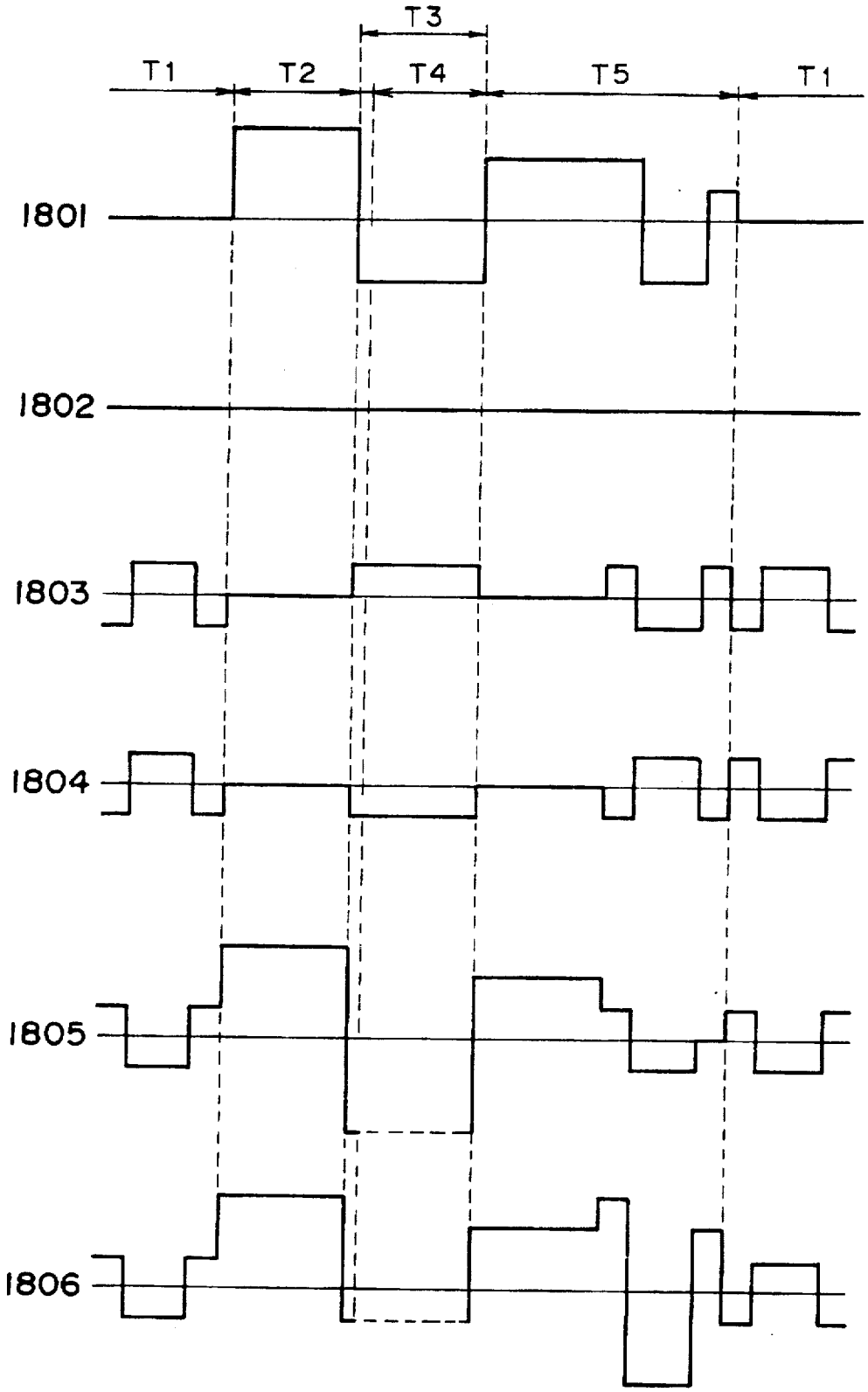
FIG. 36 is a time-serial waveform diagrams showing detection input signals used in Example 17.

FIG. 36 is a time-serial waveform diagram showing a set of waveforms applied to the system shown in FIG. 35 for the current detection. Referring to FIG. 36, at 1801 is shown a voltage waveform applied to a scanning electrode associated with the detection region, at 1802 is shown a voltage waveform applied to the other scanning electrodes, at 1803 is shown a voltage waveform applied to a data electrode associated with the detection region, at 1804 is a voltage waveform applied to the other data electrodes, at 1805 is shown a voltage waveform applied to pixels in the detection region, and at 1806 is shown a voltage waveform applied to pixels outside the detection region on the scanning electrode associated with the detection region. Further, the waveforms shown in FIG. 36 include a period $T_1$ for ordinary image display, a period $T_2$ for resetting all the pixels on the scanning electrode associated with the detection region into a black state prior to the detection, a period $T_3$ for the detection, a period $T_4$ for connecting the detection scanning electrode to the detection circuit, and a period $T_5$ for restoring the pixels associated with the current detection to the original display state.

Figure 37:
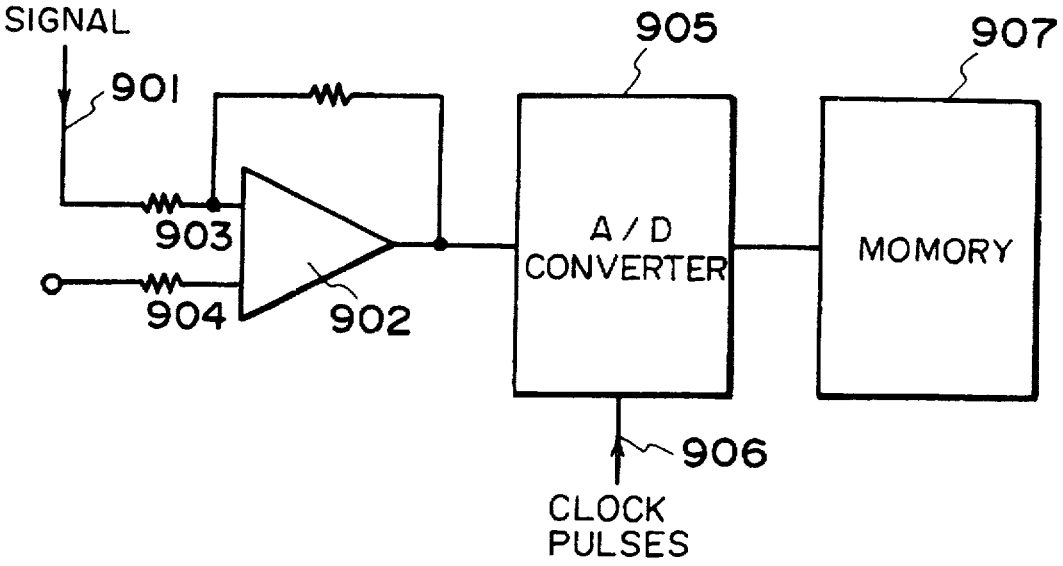
FIG. 37 is a diagram showing a detection circuit used in Example 17.

FIG. 37 is a block diagram of an embodiment of the detection circuit. Referring to FIG. 37, a detection signal is inputted through a line 901 to an input terminal 903 of an operational amplifier 902 to be amplified therein. To another terminal 904 is inputted a difference (1801–1803 in FIG. 36) between outputs from the scanning side drive circuit and the data-side drive circuit, so that only a potential change is amplified. The amplified signal is converted by an analog/digital converter 905 into a digital signal, which is time-divided with the aid of high frequency clock pulses inputted through a line 906 to the D/A converter 905, so that the time-divided signals are stored in a memory 907 for respective time.

The detection is performed at a prescribed time between ordinary display drives. More specifically, ordinary scanning in period $T_1$ is interrupted, and all the pixels on a scanning electrode 1801*a* associated with the detection region 1707 are reset into a black state in period $T_2$. In this embodiment, the black resetting is performed so as to place the pixels outside the detection region 1707 in a black state and make the pixels not readily recognizable.

Then, in period $T_3$, a detection voltage pulse is applied as a combination of pulses applied to the associated scanning electrode and data electrode so that the voltage applied to the detection region exceeds a threshold for inversion to a white state and the voltage applied to the non-detection region is below the threshold.

Slightly after the commencement of the detection pulse, a period $T_4$ for disconnecting the scanning electrode 1701*a* from the drive circuit 1703 and connecting the scanning electrode 1701*a* to the detection circuit 1705. The period of shift ($T_3$–$T_4$) is a period required for the respective electrodes to reach the potentials for detection, and is disposed in view of a possibility that an electrode portion remote from the drive circuit does not immediately reach a saturation potential due to a delay in pulse transmission. If the scanning electrode is disconnected from the drive circuit before the detection pulse voltage reaches the remote end thereof, a correct detection voltage is not applied to the detection pixel so that the detection becomes inaccurate.

The scanning electrode 1701*a* is connected to the detection circuit 1705 within the period $T_4$. The detection circuit is principally constituted by an operational amplifier 902 which can be designed to have a sufficiently large impedance, so that the scanning electrode is placed in a high-impedance state. At the detection pixel, the spontaneous polarization of the liquid crystal is inverted and, as a result, the scanning electrode potential is changed by $$\delta V=2PSA/C_{line},$$

wherein Ps denotes the spontaneous polarization of the liquid crystal, A denotes the area of the inverted region, and $C_{line}$ denotes a static capacitance for one scanning electrode with the opposite data electrodes.

The pixels outside the detection region are not inverted, thus not contributing to the potential change.

The detection is terminated when the liquid crystal inversion is completed, and the scanning electrode 1701*a* is disconnected from the detection circuit 1705 and connected to the drive circuit 1703. Simultaneously therewith, the pulses in period $T_5$ are applied to restore the pixels on the detection-selection scanning electrode 1701*a* to the original display state, and then the ordinary scanning is resumed in period $T_1$.

Figure 38:
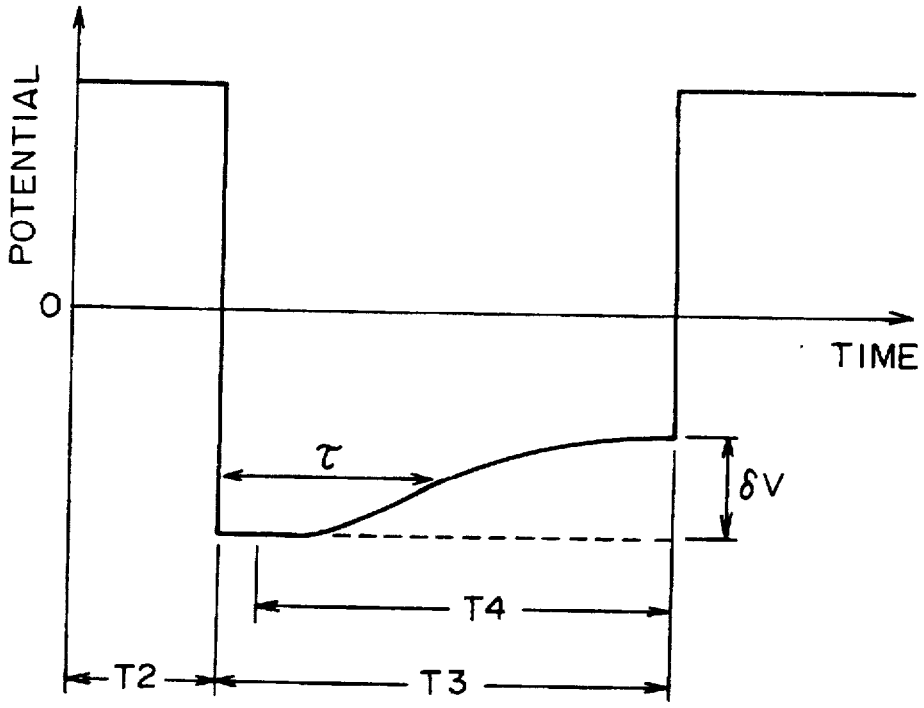
FIG. 38 is a diagram showing a potential change of a scanning electrode.

FIG. 38 shows a potential change with time of the detection-selection scanning electrode. The potential change occurs within a time on the order of the inversion response time $\tau$, and the magnitude $\delta V$ thereof is proportional to Ps. Accordingly, by detecting the potential, it is possible to know $\tau$ or Ps. The temperature-dependence of $\tau$ and Ps has been known as a function of temperature, so that it is also possible to know the temperature of the detection region.

In some cases, the cell gap of the detection region is unknown in addition to the temperature. In such cases, both Ps and $\tau$ are measured, and the temperature is obtained from Ps and further the viscosity $\eta$ of the liquid crystal is obtained based on the temperature. The viscosity is a property intrinsic to the liquid crystal material and the temperature-dependence thereof has been known similarly as Ps. Accordingly, from these values and the applied voltage V, the cell gap d can be calculated based on a well known formula:

$$\tau=\eta d/(PsV).$$

According to this embodiment, the following advantages may be attained.

(1) The detection may be performed by using only one scanning electrode, so that the image disorder is suppressed to a slight degree compared with the case wherein plural scanning electrodes are used at a time for detection, thus requiring a longer time for restoring the original display.

(2) The detection-nonselection scanning electrodes are placed on a non-selection potential so that the circuit is simple compared with the case wherein the detection-nonselection scanning electrodes and the other data electrodes are all placed in a high-impedance state, thus requiring changeover switches on both sides.

Figure 39:
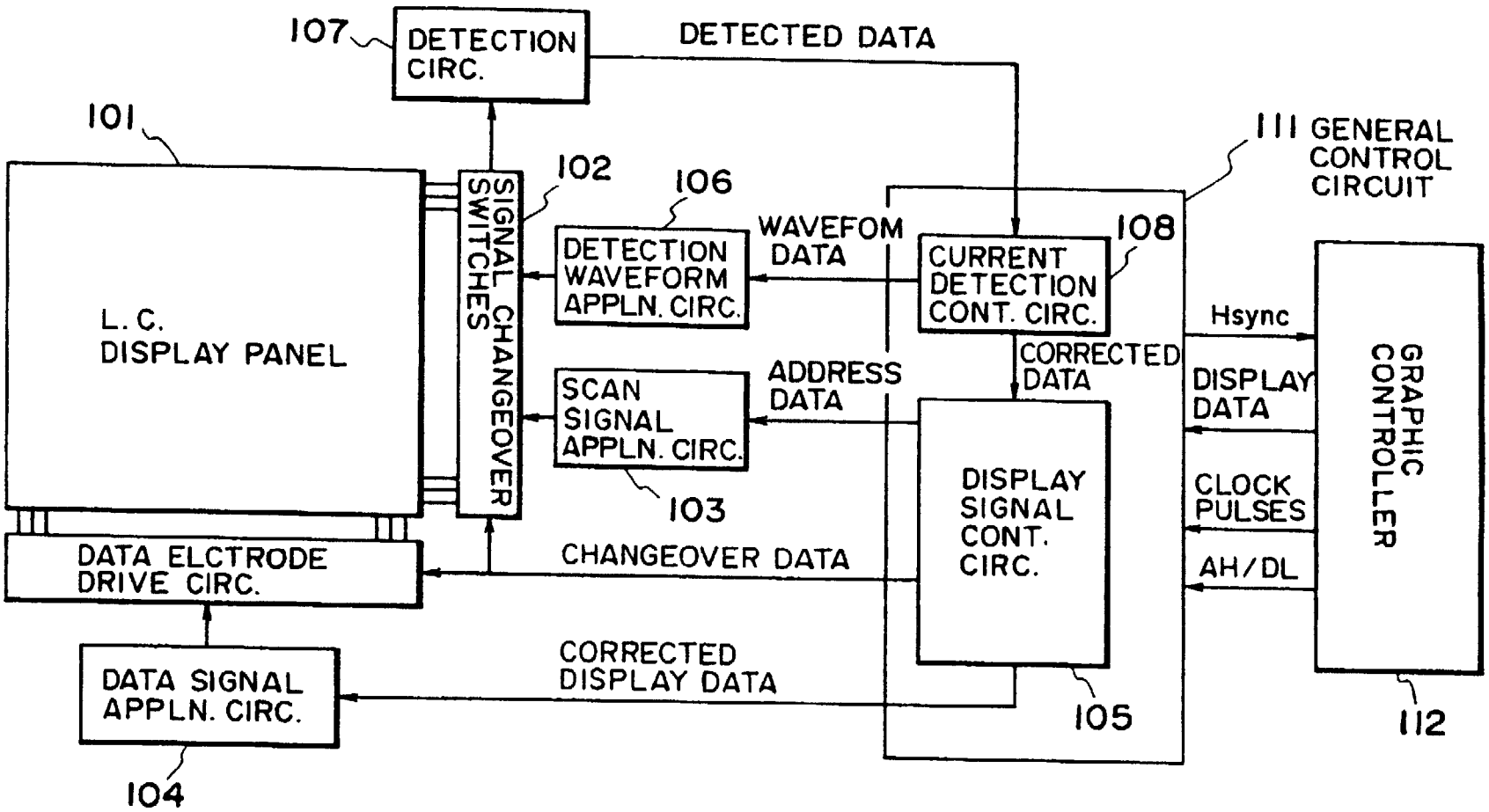
FIGS. 39 and 40 are respectively a liquid crystal display apparatus capable of using a detection method in Example 17.
Figure 40:
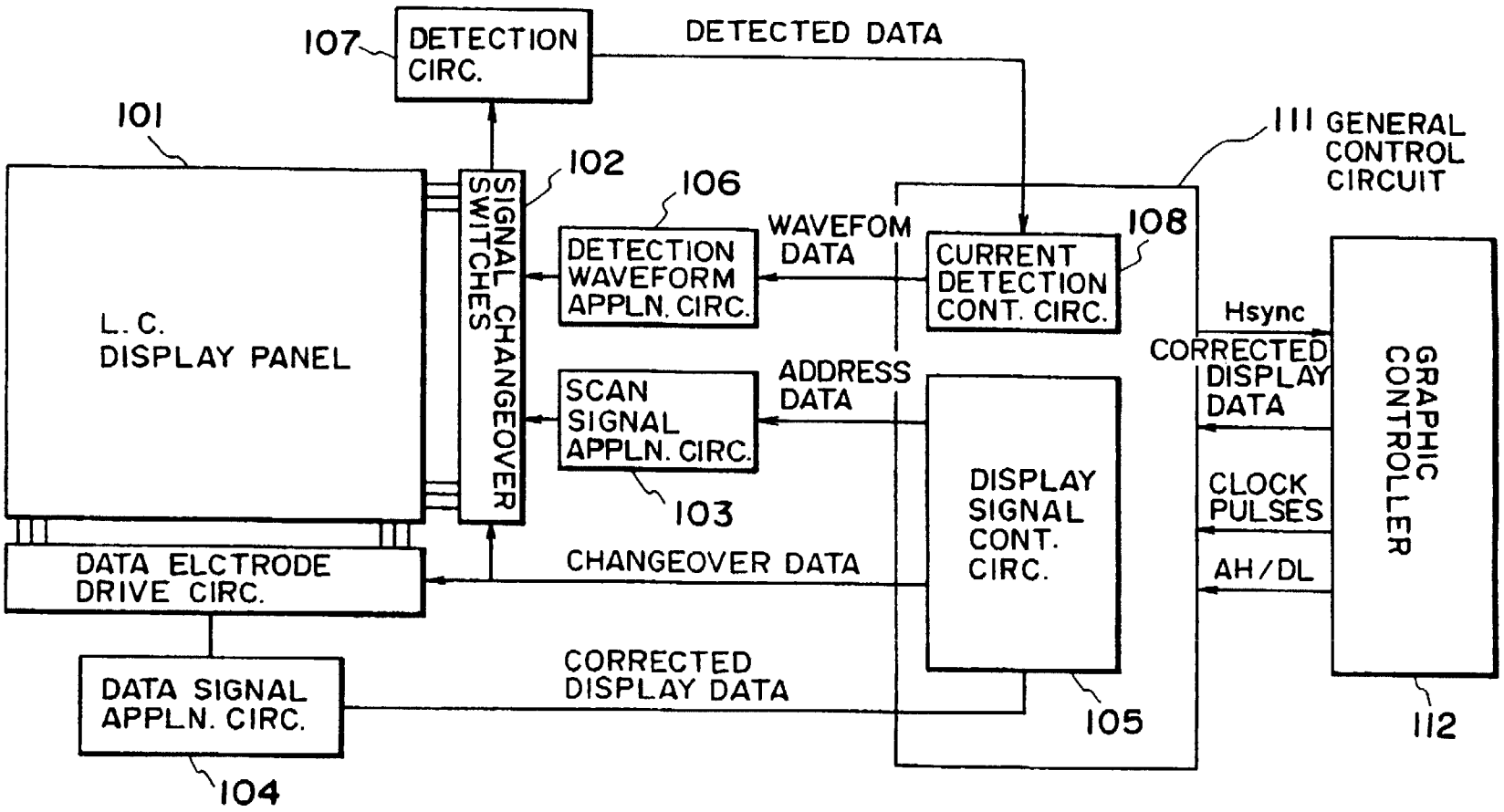

FIGS. 39 and 40 are respectively a block diagram of a liquid crystal display apparatus including a current detection system according to this embodiment.

The example ferroelectric liquid crystal having properties shown in Tables 1 and 2 appearing hereinbelow was found to show $\gamma$ (i.e., V-T) characteristics shown in the following table.

TABLE 3

| | 30° C. | 35° C. | 40° C. |
|---|---|---|---|
| $\gamma_{10-90}$ | 1.43 | 1.55 | 1.63 |
| $\gamma_{0-100}$ | 1.71 | 1.88 | 1.80 |

$\gamma_{10-90}$ in Table 3 is a value defined by $\gamma_{10-90}\equiv V_{T=90}/V_{T=10}$ wherein, when a liquid crystal initially placed in a wholly black state is supplied with voltage pulses having a fixed pulse width and varying voltages (amplitudes), $V_{T=10}$ denotes a voltage providing a transmittance of 10 % and $V_{T=90}$ denotes a voltage providing a transmittance of 90%. Similarly, $\gamma_{0-100}$ is defined by $\gamma_{0-100}=V_{T=100}/V_{T=0}$ and is identical to a ratio Vsat/Vth shown in FIG. 1A-1. Hereinafter $\gamma_{0-100}$ is simply denoted by $\gamma$. In other words, $\gamma$ represents an inclination of a V-T curve and may preferably be in a certain suitable range when the drive scheme according to the invention is applied to a halftone display. Hereinbelow, this point will be described in more detail.

Figure 41:
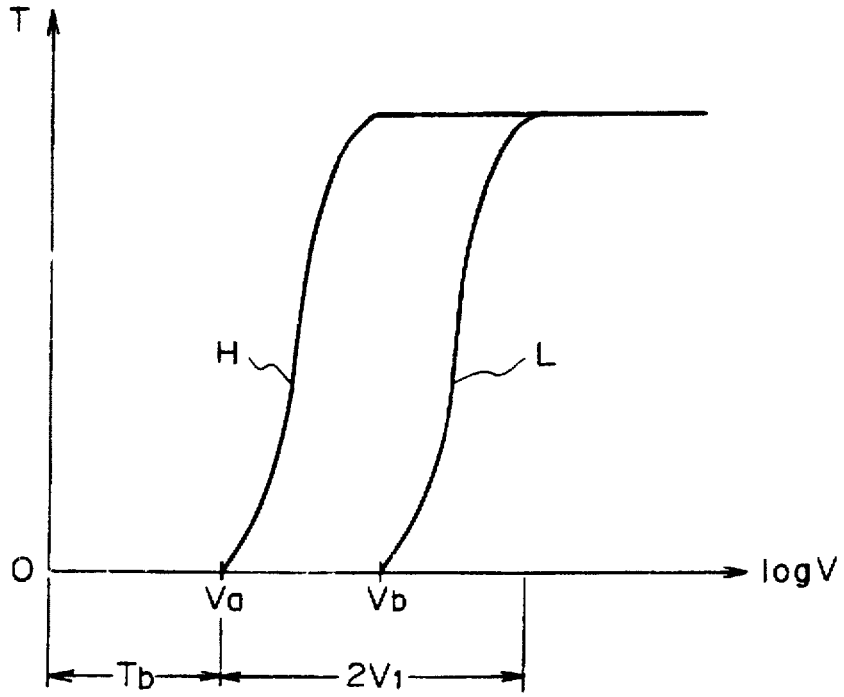
FIGS. 41 and 42 are respectively a graph showing an applied voltage-transmittance characteristic.

The compensation range is first considered. Referring to FIG. 41 showing a threshold curve H at a high temperature pixel and a threshold curve L at a low temperature pixel, $V_I$ denotes a data signal amplitude, Tb denotes a maximum crosstalk quantity, Va denotes a threshold voltage at the high temperature pixel, and Vb denotes a threshold voltage at the low temperature pixel. As the voltage for providing T=100% at the low temperature pixel is Vb$\gamma$, a condition of $$2V_I \geqq Vb\cdot\gamma - Va \quad (1)$$

is required. On the other hand, a condition of $$Tb \geqq Va \quad (2)$$

is required in order to avoid crosstalk.

Accordingly, in case of $V_I$=Tb, a condition of $$V_I \leqq Va \quad (3)$$

is required. From (1) and (3), the following condition is derived:

$$\gamma \leqq 3Va/Vb \quad (4).$$

On the other hand, in case of $V_I$=2Tb, the following condition is derived from the formula (2):

$$(1/2)V_I \leqq Va \quad (3a).$$

From (1) and (3a), the following condition is derived:

$$\gamma \leqq 5Va/Vb \quad (4a).$$

Accordingly, in case where the high temperature pixel and low temperature pixel have a large difference in threshold characteristic or, in other words, in order to compensate for a broad temperature range, it is preferred that $\tau$ is close to 1 ($\tau$(=Vsat/Vth) cannot be 1 or below).

Figure 42:
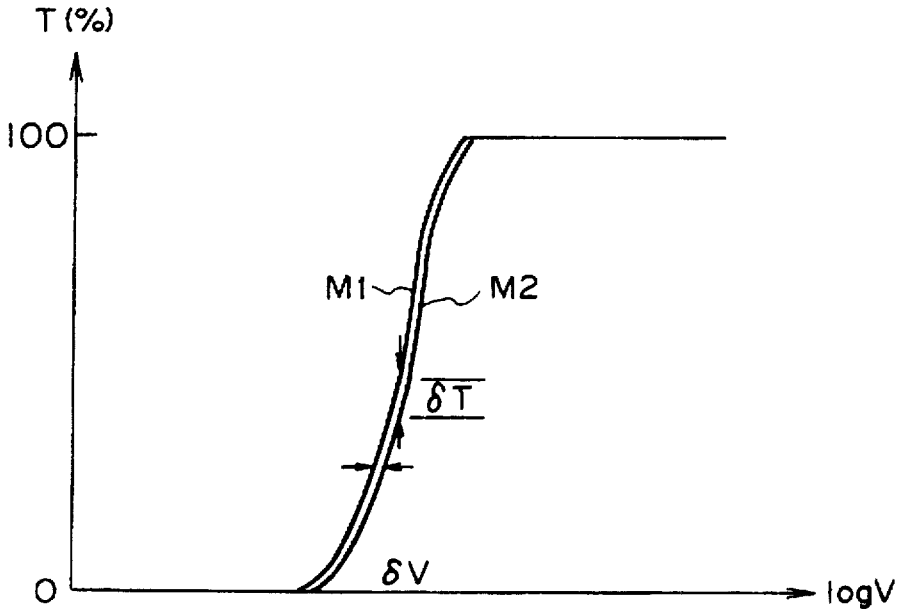

Next, a display accuracy is considered. FIG. 42 shows two threshold characteristic curves $M_1$ and $M_2$ which are slightly different from each other, wherein $\delta T$ denotes a change in transmittance, and $\delta V$ denotes a change in voltage. Now, in case of effecting a gradational display of n levels, an allowable transmittance change is given by $$\delta T \leqq 100/n\ (\%) \quad (5).$$

As a relationship of $\delta T \leqq \delta V$ exists, the following is derived:

$$\delta V/\gamma \leqq 100/n, \text{ i.e., } \gamma \geqq (n/100)\delta V \quad (6).$$

If a voltage output accuracy $\delta V$ is assumed to be a constant determiend by a circuit structure, $\gamma$ is required to be large in order to increase the number of gradation levels. As a result of combination of the constraint (4) or (4a ) regarding the compensation range and the constraint (6) regarding the display accuracy, the following range for $\gamma$ is given for the driving scheme according to the invention:

$$(n/100)\delta V \leqq \gamma \leqq 3Va/Vb, \text{ or}$$

$$(n/100)\delta V \leqq \gamma \leqq 5Va/Vb.$$

In this embodiment, it has been formed that $\gamma$ is preferably in the range of $1.3 \leqq \gamma \leqq 2.0$, particularly around 1.5.

On the other hand, if the drive scheme according to the invention is applied to a binary state display, the constraint on $\gamma$ is given by:

$$\gamma \geqq 3Va/Vb \quad (4), \text{ or}$$

$$\gamma \leqq 5Va/Vb \quad (4a).$$

In this embodiment, $\gamma \leqq 2.0$ is preferred for such binary display and particularly as close as possible to 1.

What is claimed is:

1. A liquid crystal display apparatus, including:

a display panel comprising a matrix of pixels each comprising a pair of oppositely disposed electrodes and a ferroelectric liquid crystal disposed between the electrodes;

detection means for detecting a polarization inversion current signal flowing across the liquid crystal at one of the pixels on the display panel;

drive means for applying drive signals to the display panel; and correction means for correcting the drive signals based on the polarization inversion current signal detected by the detection means, wherein said polarization inversion current signal is a difference between a first signal detected from the one pixel when polarization inversion is caused at the one pixel and a second signal detected from the signal when polarization inversion is not caused at the one pixel.

2. An apparatus according to claim 1, wherein one of said pair of oppositely disposed electrodes comprises a scanning electrode and said polarization inversion current signal is detected by applying a detection input signal to said scanning electrode and detecting an output signal from the other of said pair of oppositely disposed electrodes.

3. An apparatus according to claim 2, wherein said detection input signal includes a plurality of waveform signals applied in succession, wherein all of the waveform signals have an identical waveshape including at least one pulse, and where at least a specific one of the at least one pulse of each of the waveform signals has a respective pulsewidth different from the pulsewidths of the others of the specific pulses.

4. A liquid crystal display apparatus including:

a display panel comprising a matrix of pixels each comprising a pair of oppositely disposed electrodes, one of said pair of electrodes comprising a scanning electrode and another of said pair of electrodes comprising a data electrode, and a ferroelectric liquid crystal disposed between the electrodes;

detection means comprising a differential circuit for detecting a polarization inversion current signal flowing across the liquid crystal at first and second pixels on the display panel;

drive means for applying drive signals to the display panel; and correction means for correcting the drive signals based on the polarization inversion current signal detected by the detection means, wherein said differential circuit outputs a difference between a first signal detected from the first pixel when polarization inversion is caused at the first pixel and a second signal detected from the second pixel when polarization inversion is not caused at the second pixel, and said current signal is detected by applying a detection input signal to said scanning electrode and detecting an output signal from said data electrode.

5. An apparatus according to claim 4, wherein said detection input signal includes a plurality of different waveform signals applied in succession.

* * * * *

UNITED STATES PATENT AND TRADEMARK OFFICE

CERTIFICATE OF CORRECTION

PATENT NO. : 5,754,154

DATED : May 19, 1998

INVENTOR(S): KAZUNORI KATAKURA ET AL.

It is certified that error appears in the above-identified patent and that said Letters Patent is hereby corrected as shown below:

ON COVER PAGE AT [56] REFERENCES CITED, FOREIGN PATENT DOCUMENTS

"0002920 9/1979 European Pat. Off." should read --0002920 7/1979 European Pat. Off.--

In the Drawings:

SHEET 5

Fig. 8, "WAVEFOM" should read --WAVEFORM--.

SHEET 8

Fig. 11, "WAVEFOM" should read --WAVEFORM--.

SHEET 16

Fig. 22, "WAVEFOM" should read --WAVEFORM--.

SHEET 17

Fig. 24, "WAVEFOM" should read --WAVEFORM--.

SHEET 22

Fig. 32A, "IMAG" should read --IMAGE--; "DISPLY" should read --DISPLAY--;
Fig. 32B, "IMAG" should read --IMAGE--; "DISPLY" should read --DISPLAY--;
Fig. 32C, "IMAG" should read --IMAGE--; "DISPLY" should read --DISPLAY--.

UNITED STATES PATENT AND TRADEMARK OFFICE

CERTIFICATE OF CORRECTION

PATENT NO. : 5,754,154

DATED : May 19, 1998

INVENTOR(S): KAZUNORI KATAKURA ET AL.

It is certified that error appears in the above-identified patent and that said Letters Patent is hereby corrected as shown below:

SHEET 27

Fig. 37, "MOMORY" should read --MEMORY--.

SHEET 28

Fig. 39, "WAVEFOM" should read --WAVEFORM-- and "ELCTRODE" should read --ELECTRODE--.

SHEET 29

Fig. 40, "WAVEFOM" should read --WAVEFORM-- and "ELCTRODE" should read --ELECTRODE--.

COLUMN 2

Line 38, "actually," should read --actuality,--.

COLUMN 3

Line 6, "widths," should read --width,--;
Line 40, "if an" should read --if a--.

COLUMN 4

Line 66, "diagrams" should read --diagram--.

UNITED STATES PATENT AND TRADEMARK OFFICE

CERTIFICATE OF CORRECTION

PATENT NO. : 5,754,154

DATED : May 19, 1998

INVENTOR(S): KAZUNORI KATAKURA ET AL.

It is certified that error appears in the above-identified patent and that said Letters Patent is hereby corrected as shown below:

COLUMN 5

Line 18, "signals" should read --signal,--.

COLUMN 6

Line 1, "detected" should read --detected,--.

COLUMN 8

Line 10, "where," should read --where--;
Line 46, "the" should read -- of the--.

COLUMN 9

Line 26, "Application" should read --application--;
and "107," should be deleted.

COLUMN 15

Line 67, "at (b)" should read --¶ at (b)--.

COLUMN 16

Line 1, "at (c)" should dread --¶ at (c)--;
Line 23, "in case" should read --in a case--;
Line 29, "+10" should read --±10--;
Line 44, "applying" should read --apply--.

UNITED STATES PATENT AND TRADEMARK OFFICE

CERTIFICATE OF CORRECTION

PATENT NO. : 5,754,154

DATED : May 19, 1998

INVENTOR(S): KAZUNORI KATAKURA ET AL.

It is certified that error appears in the above-identified patent and that said Letters Patent is hereby corrected as shown below:

COLUMN 18

Line 18, "corrections" should read --correction--;
Line 48, "not performed" should read --not be performed--.

COLUMN 20

Line 44, "in case" should read --in a case--;
Lines 46-47, "in case" should read --in a case--;
Line 55, "detection" should read --detection,--.

COLUMN 21

Line 15, "in case" should read --in a case--.

COLUMN 23

Line 28, "$\delta V=2PSA/C_{line}$," should read --$\delta V-2PsA/C_{line}$,--.

COLUMN 24

Line 28, "10 %", delete boldface;
Equation (2), "$Tb \geqq Va$" should read --$Tb \leqq Va$--.

UNITED STATES PATENT AND TRADEMARK OFFICE

CERTIFICATE OF CORRECTION

PATENT NO. : 5,754,154

DATED : May 19, 1998

INVENTOR(S): KAZUNORI KATAKURA ET AL.

It is certified that error appears in the above-identified patent and that said Letters Patent is hereby corrected as shown below:

COLUMN 25

Line 1, "in case" should read --in a case--;
Line 19, "determiened" should read --determined--;
Line 35, "$\gamma \geqq 3Va/Vb$" should read --$\gamma \leqq 3Va/Vb$--.

Signed and Sealed this

Thirtieth Day of March, 1999

*Attest:*

Q. TODD DICKINSON

*Attesting Officer*

*Acting Commissioner of Patents and Trademarks*